US008323085B2

(12) United States Patent
Berman et al.

(10) Patent No.: US 8,323,085 B2
(45) Date of Patent: Dec. 4, 2012

(54) METHOD AND APPARATUS FOR INCREASING POTENTIAL PAYOUT OPPORTUNITIES IN CARD GAMES

(75) Inventors: Bradley Berman, Minnetonka, MN (US); Chad Shapiro, Plymouth, MN (US); Jacob Lamb, Maple Grove, MN (US)

(73) Assignee: King Show Games, Inc., Minnetonka, MN (US)

( * ) Notice: Subject to any disclaimer, the term of this patent is extended or adjusted under 35 U.S.C. 154(b) by 196 days.

(21) Appl. No.: 12/838,670

(22) Filed: Jul. 19, 2010

(65) Prior Publication Data

US 2012/0015703 A1 Jan. 19, 2012

(51) Int. Cl.
*A63F 9/24* (2006.01)

(52) U.S. Cl. ..... 463/13

(58) Field of Classification Search ..... 463/13
See application file for complete search history.

(56) References Cited

U.S. PATENT DOCUMENTS

| | | | | |
|---|---|---|---|---|
| 712,566 | A | 11/1902 | Moller | |
| 821,781 | A | 5/1906 | Cadwallader | |
| 1,551,761 | A | 5/1924 | McCarroll | |
| 1,693,525 | A | 8/1928 | Niederlitz | |
| 4,170,358 | A | 10/1979 | Hancock | |
| 5,280,916 | A | 1/1994 | Gleason, Jr. | |
| 5,611,535 | A | 3/1997 | Tiberio | |
| 5,890,962 | A | 4/1999 | Takemoto | |
| 6,004,208 | A | 12/1999 | Takemoto et al. | |
| 6,093,102 | A | 7/2000 | Bennett | |
| 6,123,333 | A | 9/2000 | McGinnis, Sr. et al. | |
| 6,200,217 | B1 | 3/2001 | Osawa | |
| 6,227,971 | B1 | 5/2001 | Weiss | |
| 6,241,607 | B1 | 6/2001 | Payne et al. | |
| 6,261,178 | B1 | 7/2001 | Bennett | |
| 6,398,218 | B1 | 6/2002 | Vancura | |
| 6,896,615 | B2 | 5/2005 | Berman | |
| 7,481,435 | B2 | 1/2009 | Shetterly | |
| 2004/0232616 | A1 | 11/2004 | English | |
| 2005/0173863 | A1 * | 8/2005 | Walker et al. | 273/292 |
| 2005/0208994 | A1 | 9/2005 | Berman | |
| 2005/0230917 | A1 | 10/2005 | Jackson | |
| 2006/0270477 | A1 * | 11/2006 | Snow | 463/11 |
| 2008/0254893 | A1 | 10/2008 | Patel | |
| 2009/0186676 | A1 * | 7/2009 | Amaitis et al. | 463/12 |
| 2010/0124967 | A1 * | 5/2010 | Lutnick et al. | 463/17 |

(Continued)

OTHER PUBLICATIONS

IGT, "2nd Chance Royal Poker Brochure", 2010, 2 pages.

(Continued)

*Primary Examiner* — Pierre E Elisca
(74) *Attorney, Agent, or Firm* — Stolowitz Ford Cowger LLP

(57) ABSTRACT

Systems, apparatuses and methods for increasing potential payout opportunities using multiple card indicia representing multiple cards. One embodiment involves determining whether any one or more of a plurality of cards of a draw poker hand are to be randomly provided with multiple card indicia representing multiple cards, presenting the plurality of cards of the draw poker hand, including the one or more of the plurality of cards determined to be randomly provided with multiple card indicia, facilitating user identification of which of the plurality of cards to hold, replacing the cards that are not held, and identifying a plurality of resulting hands, each of the plurality of resulting hands including a different subset of a total of the indicia of the cards that were held, the cards that were replaced, and any cards provided with multiple card indicia.

21 Claims, 10 Drawing Sheets

U.S. PATENT DOCUMENTS

2011/0275432 A1* 11/2011 Lutnick et al. ..... 463/25
2012/0077558 A1* 3/2012 Alderucci et al. ..... 463/11

OTHER PUBLICATIONS

Sigma Games, "Ten Seven Poker Brochure", 2002, 3 pages.
Notice of Allowance dated Jan. 13, 2005 from U.S. Appl. No. 09/947,619, 6 pages.
Appeal Brief dated Oct. 21, 2004 from U.S. Appl. No. 09/947,619, 35 pages.
Office Action dated May 17, 2004 from U.S. Appl. No. 09/947,619, 6 pages.
Action Response dated Mar. 5, 2004 from U.S. Appl. No. 09/947,619, 23 pages.
Office Action dated Nov. 28, 2003 from U.S. Appl. No. 09/947,619, 6 pages.
Office Action Response dated Oct. 23, 2003 from U.S. Appl. No. 09/947,619, 4 pages.
Office Action dated Sep. 23, 2003 from U.S. Appl. No. 09/947,619, 4 pages.
Notice of Allowance dated Apr. 12, 2010 from U.S. Appl. No. 11/134,968, 9 pages.
Office Action Response dated Dec. 9, 2009 from U.S. Appl. No. 11/134,968, 13 pages.
Interview Summary dated Oct. 23, 2009 from U.S. Appl. No. 11/134,968, 3 pages.
Office Action dated Sep. 9, 2009 from U.S. Appl. No. 11/134,968, 10 pages.
Office Action Response dated Aug. 4, 2009 from U.S. Appl. No. 11/134,968, 10 pages.
Office Action dated Feb. 4, 2009 from U.S. Appl. No. 11/134,968, 11 pages.
Office Action Response dated Oct. 22, 2008 from U.S. Appl. No. 11/134,968, 11 pages.
Office Action dated May 22, 2008 from U.S. Appl. No. 11/134,968, 7 pages.
Office Action Response dated Oct. 22, 2007 from U.S. Appl. No. 11/134,968, 8 pages.
Office Action dated Apr. 17, 2007 from U.S. Appl. No. 11/134,968, 9 pages.
Office Action Response dated Jan. 12, 2007 from U.S. Appl. No. 11/134,968, 15 pages.
Office Action dated Aug. 9, 2007 from U.S. Appl. No. 11/134,968, 7 pages.

* cited by examiner

400

| | | 410 BET 1 | 411 BET 2 | 412 BET 3 | 413 BET 4 | 414 BET 5 |
|---|---|---|---|---|---|---|
| 409 | ROYAL FLUSH | 200 | 400 | 600 | 800 | 4000 |
| 408 | STRAIGHT FLUSH | 50 | 100 | 150 | 200 | 250 |
| 407 | FOUR OF A KIND | 25 | 50 | 75 | 100 | 125 |
| 406 | FULL HOUSE | 9 | 18 | 27 | 36 | 45 |
| 405 | FLUSH | 6 | 12 | 18 | 24 | 30 |
| 404 | STRAIGHT | 4 | 8 | 12 | 16 | 20 |
| 403 | THREE OF A KIND | 3 | 6 | 9 | 12 | 15 |
| 402 | TWO PAIR | 2 | 4 | 6 | 8 | 10 |
| 401 | JACKS OR BETTER | 1 | 2 | 3 | 4 | 5 |

METHOD AND APPARATUS FOR INCREASING POTENTIAL PAYOUT OPPORTUNITIES IN CARD GAMES

FIELD OF THE INVENTION

This invention relates in general to games, and more particularly to systems, apparatuses and methods for providing additional payout opportunities in card games.

BACKGROUND

Card games such as poker have long been enjoyed as a means of entertainment. The popularity of casino gambling with wagering continues to increase, as does recreational gaming such as non-wagering computer-based competition and gambling. While live table games remain very popular, electronic forms of participating in poker games are on the rise. Electronic forms include, for example, online gaming, casino "slot machines" and other gaming kiosks.

While the underlying poker games provided by electronic poker/gaming machines may be highly enjoyable, they lack the social interaction of live table games. Without this external aspect, continued play of the same poker or other card game, however enjoyable it may be, can become mundane over long periods of time. Nevertheless, electronic games have additional capabilities over live table games, as hardware and software can often provide features that are impossible or otherwise impractical in live table games. It is desirable to provide such additional capabilities in an effort to hold players' interest in games such as poker games.

One shortcoming of many live and electronic poker/card games is that they provide only static opportunities to win. In other words, play of the game remains the same for each hand or other gaming event in which the player participates. As indicated above, this can become routine and repetitive, or in the worst case monotonous.

The shortcomings of the prior art are also applicable to other gaming activities. Accordingly, there is a need in the gaming industry for manners of providing dynamic aspects to such games that will hold players' interest, and provide for a greater degree of anticipation and excitement. The present invention addresses these and other shortcomings of the prior art by providing, among other things, otherwise unexpected opportunities and/or additional opportunities. Thus, the present invention offers advantages and provides solutions to the shortcomings of the prior art.

SUMMARY

To overcome limitations in the prior art described above, and to overcome other limitations that will become apparent upon reading and understanding the present specification, the present invention discloses systems, apparatuses and methods for augmenting payout opportunities in gaming activities.

Generally, the present invention provides systems, apparatuses and methods for enabling payout consideration for multiple resulting hands, at least some of which are the result of randomly presenting multiple card indicia that provides a greater number of useable card indicia than the number of cards of the resulting hands.

In accordance with one embodiment, a method is provided which involves determining whether any one or more of a plurality of cards of a draw poker hand are to be randomly provided with multiple card indicia representing multiple cards. The plurality of cards of the draw poker hand are presented, which includes any of the cards determined to be randomly provided with multiple card indicia. This particular method enables an identification of which of the cards to hold, and replacement of the cards that were not held. This representative method further involves identifying a plurality of resulting hands, each of the plurality of resulting hands including a different subset of a total of the indicia of the cards that were held, the cards that were replaced, and any cards provided with multiple card indicia. In other embodiments, a computer-readable medium having instructions stored thereon which are executable by a computer system is provided to perform such features.

In accordance with a variation of such a method, a payout may further be provided for any of the plurality of resulting hands that matches one of a plurality of winning poker rank thresholds.

In another example, a payout may be provided for any of the plurality of resulting hands that comply with a payout rule. In a more particular example, providing a payout for any of the plurality of resulting hands that complies with a payout rule may involve providing a payout for at most one resulting hand that matches each winning poker rank threshold. In another particular example, providing a payout for any of the plurality of resulting hands that complies with a payout rule may involve providing a payout for a predetermined number of the resulting hands that match each winning poker rank threshold.

In still other variations of such a method, presenting the one or more of the includes, for each of the one or more cards determined to be randomly provided, presenting the multiple card indicia representing the multiple cards substantially in place of what would otherwise be a respective single card of the draw poker hand.

In another variation of such a method, identifying a plurality of resulting hands involves identifying each five-card subset of the six or more indicia presented by way of the cards that were held, the cards that were replaced, and any of the held and replacement cards provided with the multiple card indicia.

In another variation, determining whether any one or more of a plurality of cards of a draw poker hand is to be randomly provided with multiple card indicia representing multiple cards involves utilizing a random number generator to facilitate the determination of whether any one or more of a plurality of cards of a draw poker hand is to be randomly provided with multiple card indicia representing multiple cards.

In still another variation of such a method, facilitating user identification of which of the plurality of cards to hold involves providing the user with a user interface capable of enabling identification of any of the plurality of cards in which to hold.

Another embodiment of such a method includes holding each of the multiple card indicia for the one or more cards held by the user that are provided with the multiple card indicia.

In another embodiment of such a method, presenting the cards determined to be randomly provided with multiple card indicia involves presenting the cards determined to be randomly provided with multiple card indicia as single cards each having a plurality of different card indicia thereon.

In yet another embodiment, presenting the cards determined to be randomly provided with multiple card indicia comprises presenting the cards determined to be randomly provided with multiple card indicia as multiple overlapping cards each having a plurality of different card indicia thereon.

In one embodiment, replacing the cards that are not held involves replacing the cards that were not held with cards that each include only one card indicium.

In still another variation of this method, replacing the cards that are not held involves replacing the cards that were not held with one or more first cards that each include only one card indicium, and with one or more second cards that each include a plurality of indicia. In yet another embodiment, replacing the cards that are not held involves replacing the cards that were not held with cards each include a plurality of indicia.

According to another method for use in a card game, a plurality of first cards are presented, such as dealt in a live table game or by way of a virtual deal in an electronic embodiment. Multiple card indicia representing multiple cards are randomly presented, such as randomly in a deck(s) of cards or by way of a processor and/or random number generation module in an electronic embodiment. In an embodiment, whether any multiple card indicia is presented is randomly determined; where in other embodiments this random presentation and/or how many multiple card indicia are presented is randomly determined. In the exemplary embodiment, if/when multiple card indicia representing multiple cards is presented, it is presented in place of what would otherwise be one or more respective single cards of that card game. The exemplary method further involves determining at least one resulting hand, each of the at least one resulting hands using a subset of the total of the one or more first cards and the multiple cards represented by the multiple card indicia.

In one variation of such a method, determining at least one resulting hand involves determining all winning resulting hand based on poker rank from all possible combinations of the total of the one or more first cards and the multiple cards represented by the multiple card indicia. In another embodiment, determining at least one resulting hand involves determining a best five-card resulting hand based on poker rank from all possible combinations of the total of the one or more first cards and the multiple cards represented by the multiple card indicia.

Another variation of such a method involves presenting multiple card indicia by presenting a single card having the multiple card indicia, such as a split card. In another embodiment, the multi-indicia card relates to the presentation of multiple cards at a position otherwise occupied by one of the first cards.

Any number of the multiple card indicia may be used in lieu of respective single card indicia. For example, in one embodiment, such a method further involves presenting additional multiple card indicia representing additional multiple cards in place of what would otherwise be one or more of the single cards of the card game. Determining a resulting hand may, in such an embodiment, be accomplished by determining a resulting hand using less than all of a total of the one or more first cards, the multiple cards represented by the multiple card indicia, and the additional multiple cards represented by the additional card indicia. In a particular example, the resulting hand may be composed of five cards, such that determining the resulting hand involves using the best five cards from the total of the one or more first cards, the multiple cards represented by the multiple card indicia, and the additional multiple cards represented by the additional card indicia.

According to another embodiment, an apparatus is provided that includes a processing module capable of carrying out functional features associated with the operational description provided herein. The processing module of the exemplary apparatus may be implemented using, for example, a processor(s) that is programmed to perform the desired features. A and random-number generator may be used, which may be integral to the processor or may be separate therefrom. In one embodiment, the processor is configured to determine whether any one or more of a plurality of cards of a draw poker hand are to be randomly provided with multiple card indicia representing multiple cards. A display is provided to present the plurality of cards of the draw poker hand, and to present the one or more of the plurality of cards having multiple card indicia if the processor determined any of the one or more of the cards of the draw poker hand to be provided with multiple card indicia. In this embodiment, a user interface is configured to be capable of receiving an indication of which of the plurality of cards of the draw poker hand to hold. The processor is further configured to replace the cards that are not held, and to identify a plurality of resulting hands, where each of the plurality of resulting hands includes a different subset of a total of the indicia of the cards that were held, the cards that were replaced, and any cards provided with multiple card indicia.

In a particular embodiment of such an apparatus, the processor is configured to identify every five-card combination of the total of the indicia of the cards that were held, the cards that were replaced, and any cards provided with multiple card indicia. In a more particular embodiment, the processor is further configured to compare each of the five-card combinations to at least one paytable of poker ranks, and to award a payout for all of the five-card combinations matching any of the poker ranks in the paytable. In an alternative embodiment, the processor is configured to compare each of the five-card combinations to at least one paytable of poker ranks, and to award a payout for a predetermined number of the five-card combinations matching a respective one of the poker ranks in the paytable. In another alternative embodiment, the processor is configured to compare each of the five-card combinations to at least one paytable of poker ranks, and to award a payout for the best five-card combination matching a respective one of the poker ranks in the paytable.

These and various other advantages and features of novelty are pointed out with particularity in the claims annexed hereto and form a part hereof. However, for a better understanding of the operation and advantages, reference should be made to the drawings which form a further part hereof, and to accompanying descriptive matter, in which there are illustrated and described representative examples of systems, apparatuses, and methods in accordance with the invention.

BRIEF DESCRIPTION OF THE DRAWINGS

The description herein refers to embodiments illustrated in the following diagrams.

DETAILED DESCRIPTION OF THE ILLUSTRATED EMBODIMENTS

Figure 1:
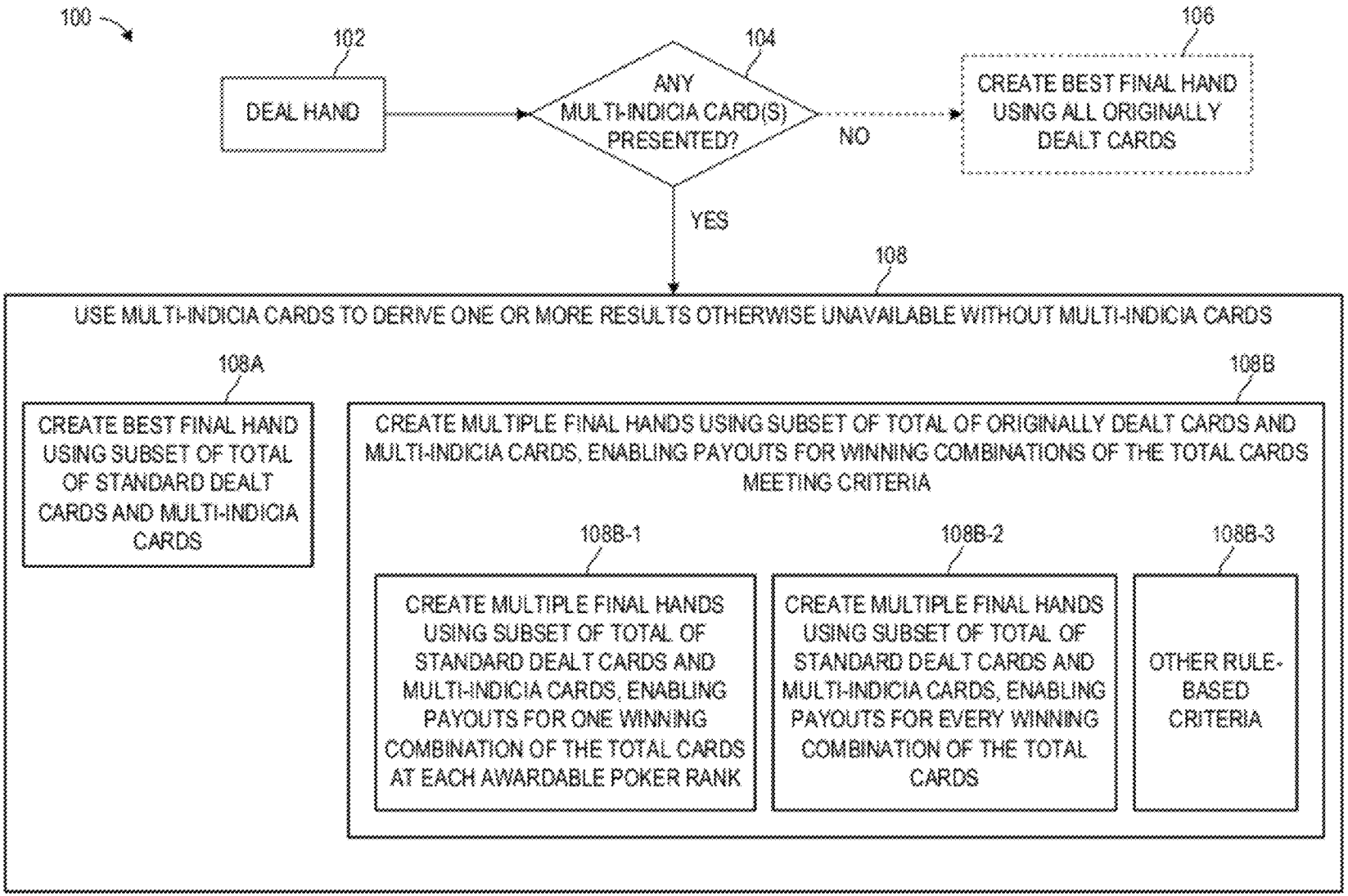
FIG. 1 is a flow diagram generally illustrating a representative manner of increasing payout opportunities in accordance with the invention.

In the following description of various exemplary embodiments, reference is made to the accompanying drawings which form a part hereof, and in which is shown by way of illustration various embodiments in which the invention may be practiced. It is to be understood that other embodiments may be utilized, as structural and operational changes may be made without departing from the scope of the invention.

Generally, systems, apparatuses and methods are provided for enabling payout consideration for multiple resulting hands in a poker game hand that typically offers only a single card combination to produce a single result, or that at least offers fewer resulting hands than would be available without the benefit of the systems, apparatuses and methods described herein.

In accordance with one embodiment, multiple card indicia are randomly provided in lieu of what would otherwise be a single card available to the player. The multiple card indicia may be used in connection with a single card, or multiple cards may be provided with the benefit of multiple card indicia. In this manner, additional card indicia is randomly available to derive additional resulting poker hands, which consequently may result in a greater number of winning hands.

For example, one embodiment involves presenting one or more first cards, and randomly presenting multiple card indicia respectively representing multiple second cards in place of what would otherwise be a single card of the card game. At least one resulting hand is identified, where each of the resulting hands uses a subset of the total of the one or more first cards and the multiple second cards represented by the multiple card indicia. In other embodiments, all of the cards dealt may include multiple indicia, in which case each of the resulting hands uses a subset of the total of the multiple second cards represented by their respective multiple card indicia.

In another example specific to draw poker, it may be determined whether any one or more of a plurality of cards of a draw poker hand are to be randomly provided with multiple card indicia representing multiple cards. The plurality of cards of the draw poker hand are presented, including the one or more of the plurality of cards determined to be randomly provided with multiple card indicia. The player is afforded an opportunity to identify which of the cards to hold, and cards that are not held are replaced. A plurality of resulting hands are identified, where each of the plurality of resulting hands includes a different subset of a total of the indicia of the cards that were held, the cards that were replaced, and any cards provided with multiple card indicia. In some embodiments, one more of the replacement cards may also be multi-indicia cards.

Other embodiments involve an apparatus configured to utilize multiple card indicia to perform features described herein. For example, a processing module may be configured to determine whether any one or more of a plurality of cards of a draw poker hand are to be randomly provided with multiple card indicia representing multiple cards. The processing module may be implemented using, for example, a processor (which includes a single processor, multiple processors, distributed processor, etc.), a random-number generator which may be implemented in circuitry and/or processor, etc. A display may present the plurality of cards of the draw poker hand, including the one or more of the plurality of cards determined to be randomly provided with multiple card indicia. The player may be afforded an opportunity to identify which of the cards to hold, such as by way of a user interface, and cards that are not held are replaced using the processing module. A plurality of resulting hands may be identified by the processing module, where each of the plurality of resulting hands includes a different subset of a total of the indicia of the cards that were held, the cards that were replaced, and any cards provided with multiple card indicia. Again, in some embodiments, one more of the replacement cards may also be multi-indicia cards.

FIG. 1 is a flow diagram generally illustrating a representative embodiment in accordance with the invention. As described more fully below, the embodiment of FIG. 1 generally involves determining whether a card position(s) is occupied by a split card(s), multiple card(s), and/or other manner of providing multiple card indicia representing multiple cards. If so, the embodiment of FIG. 1 involves enabling the possibility of multiple payout results in view of predetermined or random criteria enabling multiple combinations of the total card indicia to be considered.

In the illustrated embodiment, a poker/card game 100 is depicted, which includes providing cards 102, such as by dealing cards, presenting virtual cards electronically, or the like. The hand(s) 102 may be dealt by a dealer in a live table version of the card game, or by a virtual dealer in electronic embodiments. In accordance with an embodiment, one or more of the cards that are dealt in the hand 102 may include multiple card indicia representative of multiple cards. In one embodiment, one or more cards that would normally be dealt are randomly replaced by a card or cards that include the multiple card indicia. The multiple card indicia may be provided in substantially the same position that the normal single card would otherwise have been dealt, although this is not required. For example, in one embodiment the multiple indicia is provided on a representation of a single card that includes two or more card indicia, e.g., a split card, which may be dealt to approximately the position that a typical single-indicium card would otherwise have been positioned. In another embodiment, the multiple indicia may be provided by way of dealing multiple cards, which may be dealt in a manner substantially in place of what would otherwise be a single card (e.g., overlapping cards) or simply dealt into new positions.

It should also be noted that the determination of whether any multiple-indicia cards (or multiple cards representing the multiple indicia) does not necessarily occur on every played hand. In one embodiment, the occurrence of multi-indicia cards is purely random. In other instances, it is random but weighted in the sense that the likelihood of one or more cards having multiple indicia is somewhat controllable or adjustable. The term "random" is used herein regardless of the level of randomness used; e.g., "random" is used whether purely random or weighted-random. Thus, multi-indicia cards (which includes an item including multiple card indicia or other manner of providing the multiple card indicia) may or may not be provided in connection with each dealt hand. In some embodiments, more than one, and up to all of the dealt cards may be associated with the multiple card indicia. For example, where five cards are to be "dealt," one card may be a normal card with a single card indicia, three may have two card indicia, and the final card may have three card indicia. Another hand may have all five cards with the normal single card indicia. Thus, in one embodiment, it is random as to whether any card will be provided with multiple card indicia, as well as how many cards will have multiple card indicia, and how many indicia will be provided on multi-indicia cards.

At decision block 104, it is determined whether any multi-indicia cards have been presented, such as in an electronic video poker embodiment. Each multi-indicia card may be presented in various manners, such as represented by a single card having multiple card indicia thereon. For example, a single card may be presented that includes indicia for two different cards, such as an Ace-Clubs and a Queen-Spades. In another embodiment, the multiple-indicia cards may be represented by two or more cards placed approximately at the position where a single card would otherwise be positioned. Alternatively, the multiple cards being provided in lieu of a typical single card may be dealt or provided anywhere, and need not be provided in a common position to where the typical single card would have been positioned. Some embodiments involve providing the multiple card indicia at one position to represent one of the cards of the dealt hand 102, where in other embodiments two or more of the cards of the dealt hand 102 may be provided with multiple indicia.

Figure 2A:
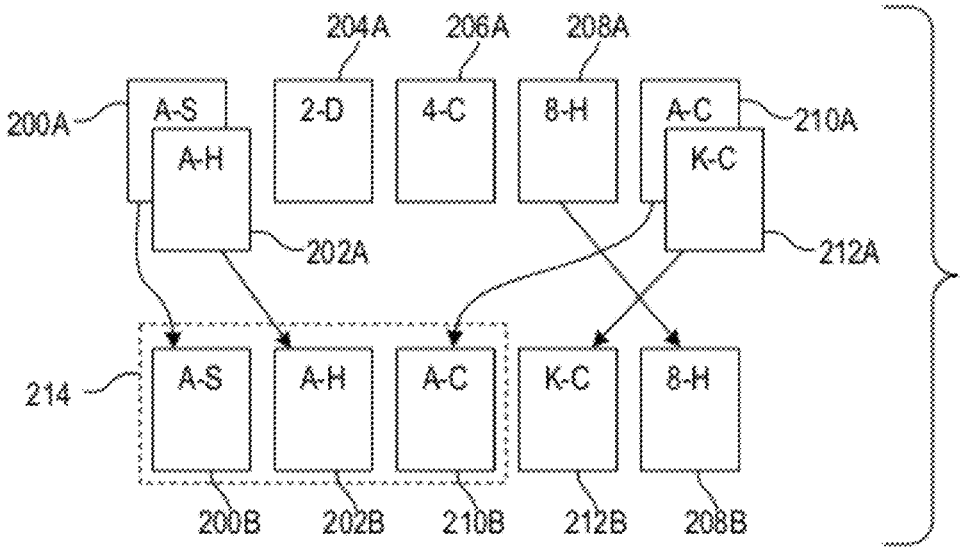
FIG. 2A depicts an exemplary embodiment in which the best final hand is created using a subset of the total of the dealt standard and multi-indicia cards.

If it is determined 104 that no multiple card indicia have been presented, then the best final hand may be created 106 using the originally dealt cards. On the other hand, if one or more multi-indicia cards have been presented 104 in lieu of one or more cards of the dealt hand 102, the multi-indicia cards are used 108 to determine whether one or more results can be derived that would otherwise be unavailable without the use of the multiple card indicia. For example, in one embodiment, the best final hand is created 108A using a subset of the total of originally dealt cards and the multi-indicia cards. For example, looking to FIG. 2A, a representative five-card hand is dealt that includes three regular single-indicia cards, namely the 2-Diamonds (2-D) 204A, 4-Clubs (4-C) 206A and 8-Hearts (8-H) 208A. The exemplary five-card hand also includes two cards provided with the multiple card indicia, namely the Ace-Spades (A-S) 200A and Ace-Hearts (A-H) 202A provided in lieu of what would otherwise be a single card dealt in the hand, and the Ace-Clubs (A-C) 210A and King-Clubs (K-C) 212A provided in lieu of what would otherwise be another single card dealt in the hand. In accordance with the embodiment of FIG. 1 shown at block 108A, the "best" final hand based on standard poker rank that can be made using a subset of the total of the single-indicia cards and the multi-indicia cards is three-of-a-kind 214 in Aces (i.e. A-S 200B, A-H 202B and A-C 210B). As described in more detail below, other embodiments involve identifying a plurality of resulting hands using various subsets of the total of the single-indicia and multi-indicia cards.

Figure 2B:
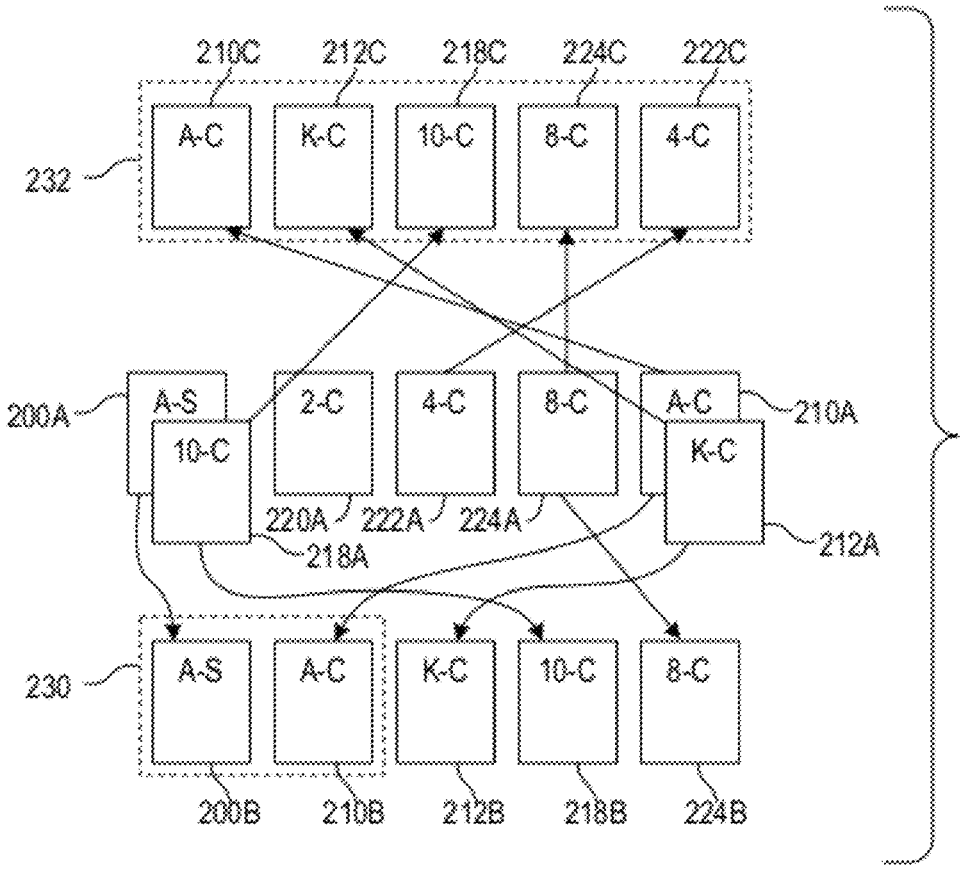
FIG. 2B depicts an exemplary embodiment in which multiple final hands have opportunities for payouts through the use of payout rules applied to the multiple hands created using the subsets of the total of the dealt standard and multi-indicia cards.

In other embodiments, multiple final hands are identified 108B using a subset of the total of standard cards that were dealt and the multi-indicia cards that were dealt, making possible multiple payouts for multiple winning combinations of the total cards meeting certain criteria. For example, one or more multiple final hands may be created 108B-1 using a subset of the total of the standard cards and multi-indicia cards, enabling payouts for one winning combination of the total cards at each awardable poker rank. For example, rules may be used to indicate that only one flush may be awarded, one full-house may be awarded, one three-of-a-kind may be awarded, etc. An example is shown in FIG. 2B. In this example, a representative five-card hand is dealt that includes three regular single-indicia cards, namely the 2-Clubs 220A, 4-Clubs 222A and 8-Clubs 224A. The exemplary five-card hand also includes two cards provided with the multiple card indicia, namely the A-Spades 200A and 10-Clubs 218A provided in lieu of what would otherwise be a single card dealt in the hand, and the A-Clubs 210A and King-Clubs 212A provided in lieu of what would otherwise be another single card dealt in the hand. In accordance with the embodiment of FIG. 1 shown at block 108B-1, multiple final hands are identified while enabling payouts at only one winning combination of the total cards at each awardable poker rank. More particularly, where one awardable poker rank is a pair, the resulting hand 230 shows that a pair of Aces (i.e. A-S 200B and A-C 210B) is a winning poker rank that can provide a payout to a player. If another pair(s) existed in this embodiment, another payout may not be provided for the other pair(s). However, FIG. 2B shows that another awardable poker rank has been identified from the seven card indicia, which is a flush shown at resulting hand 232 (i.e. A-C 210C, K-C 212C, 10-C 218C, 8-C 224C and 4-C 222C). In this embodiment, another club exists, namely the 2-C 220A, but it is not payable because one flush has already been paid on that awardable poker rank (i.e. flush). As can be seen, this embodiment involves the use of rules that specify which identified subsets of the total card indicia items will be candidates for payouts. As described in greater detail below, any desired rules may be established to specify what subsets of the total card indicia is available for payouts.

In still other embodiments, multiple final hands may be created 108B-2 using a subset of a total of the originally dealt cards and the multi-indicia cards, enabling payouts for every winning combination of the total cards. For example, a dealt multi-indicia card may include three Aces, which can be used with the remaining four standard cards that were dealt. If the remaining four standard cards were, for example, a 6-H, 8-H, 10-C and Jack-C, three-of-a kind (three Aces) would be available for each combination of the three Aces and two of the remaining originally dealt cards. This is shown by example in Table 1 below:

TABLE 1

| DEALT CARDS | | AWARDABLE SUBSETS/ RESULTING HANDS |
|---|---|---|
| A-C/A-D | (multi-indicia card) | A-C, A-D, A-H, 6-H, 8-H |
| A-H | (single-indicia card) | A-C, A-D, A-H, 6-H, 10-C |
| 6-H/8-H | (multi-indicia card) | A-C, A-D, A-H, 6-H, J-C |
| 10-C | (single-indicia card) | A-C, A-D, A-H, 8-H, 10-C |
| J-C | (single-indicia card) | A-C, A-D, A-H, 8-H, J-C |
| | | A-C, A-D, A-H, 10-C, J-C |

Thus, in this embodiment, rules allow the three-of-a-kind with Aces to be used in connection with each of the statistical combinations to provide a total of six payouts of three-of-a-kind In another similar embodiment, every combination of all poker ranks may be used to identify payouts. For example, in the example of Table 1, in addition to the six combinations providing payouts for three-of-a-kind, each "pair" of Aces in combination with the other five cards can also provide payouts for a pair. This can be done with, or without, inclusion of the third Ace in each determined subset. As can be seen, this can provide a large number of awardable payouts, as the statistical combinations of each pair of Aces with each of the remaining five cards (or the remaining four cards if the third Ace is not allowed by rules to be used) can be large depending on the particular cards that are dealt, and the number of multi-indicia cards that are dealt.

Returning to FIG. 1, it is noted that other 108B-3 manners may be implemented of creating 108B multiple final hands using a subset of the total of the cards and multi-indicia cards. Other rules than those described in connection with blocks 108B-1 and 108B-2 may be developed to determine which identifiable subsets of the total dealt card indicia may be an awardable subset/hand.

The operational and structural features described herein may be used in connection with numerous poker-related card games, including but not limited to draw poker, hold'em poker, Omaha poker, and various X-card stud poker games where the multi-indicia cards increases the number of cards beyond the standard "X" cards in the X-card stud poker game. As the inclusion of multi-indicia cards is random in one embodiment, the player is unaware of if and when a multi-indicia card(s) will be presented and available for use by the player. An example of the use of the present invention is now described in connection with a draw poker game, where the player is allowed to hold and discard cards from a dealt hand of cards, and obtain replacement cards for any discarded cards.

Figure 3:
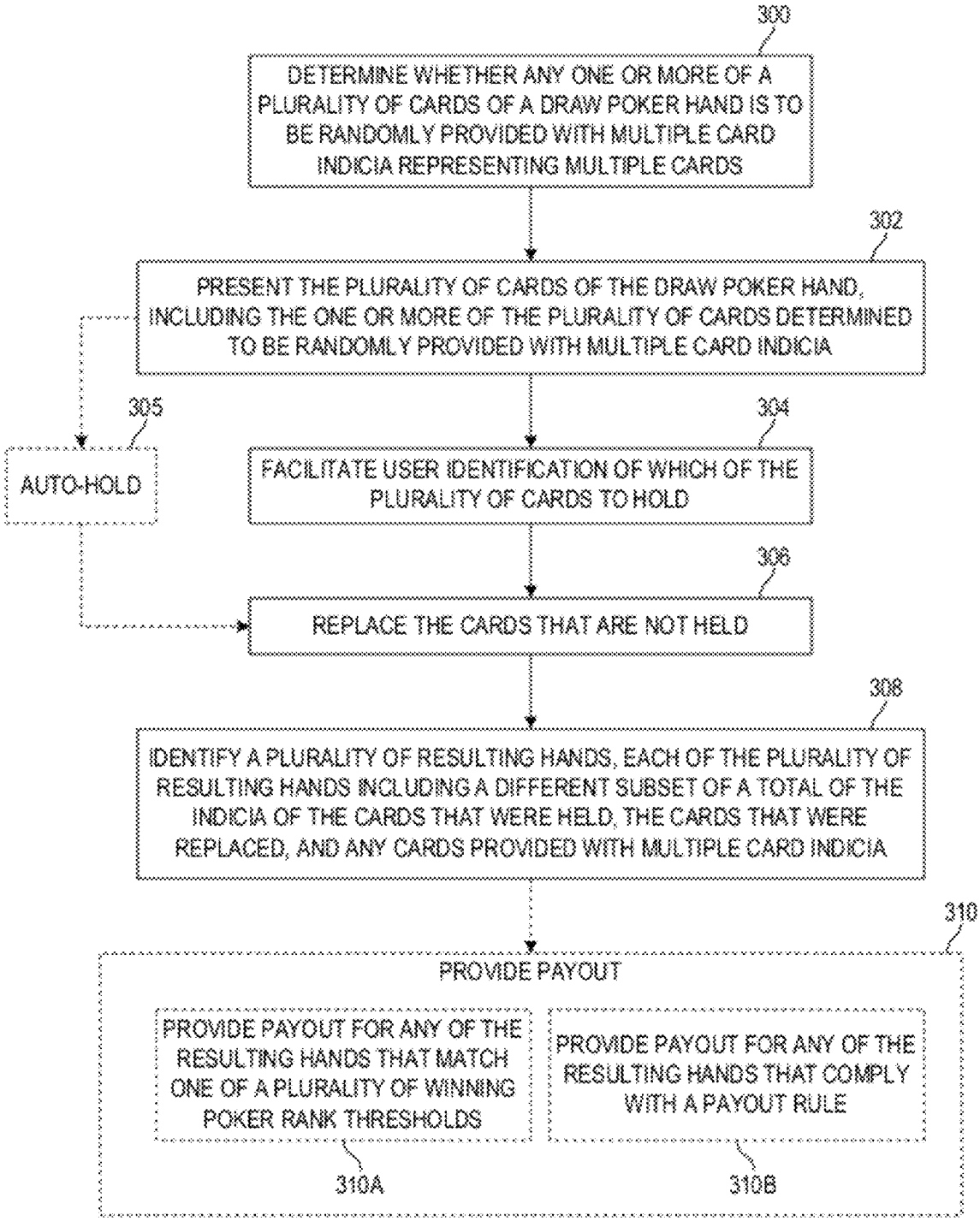
FIG. 3 is a flow diagram generally illustrating one embodiment of a random utilization of multiple card indicia used in connection with a draw poker game

FIG. 3 is a flow diagram generally illustrating one embodiment of a random utilization of multiple card indicia used in connection with a draw poker game. In the illustrated embodiment, it is determined 300 whether any one or more of a plurality of cards of the draw poker hand is/are to be randomly provided with multiple card indicia representing multiple cards. For example, a processor and/or random number generator may be used to determine whether any multi-indicia cards (including multiple cards each having a single indicia) are to be provided in lieu of a single card(s). In some cases, the hand may be dealt with no multi-indicia cards. In other cases, one, two or up to all of the dealt cards may be multi-indicia cards with any quantity of multiple card indicia respectively associated therewith. The plurality of cards may then be dealt, which in an electronic embodiment may be accomplished by visually and/or audibly presenting the cards for the player's benefit. The cards presented include any of the one or more cards determined to be randomly provided with multiple card indicia. It should be noted that no particular timing sequence should be inferred from the visual sequence of functions in FIG. 3; e.g., the determination 300 may be determined in advance of presenting 302 the cards, during the presentation 302 of the cards, or even after the presentation 302 of the cards such as where a single-indicia card transforms into a multi-indicia card.

According to one draw poker embodiment, the player is enabled to identify 304 which of the plurality of cards to "hold," and cards that are not held are replaced 306. Allowing the player to identify 304 which of the cards to hold may be accomplished in an electronic embodiment by providing one or more user interface mechanisms, such as buttons, touch screen, voice input, joystick, and/or any other manner of facilitating user designation of one or more of the presented cards to hold.

In another embodiment, an automatic hold (auto-hold) feature 305 is employed, where rules are used to automatically determine which cards, if any, to hold on the player's behalf. For example, the processor or other control mechanism may determine which cards to hold based on which cards have the highest probability of providing a resulting hand(s) with the highest poker rank. This, or any other desired criteria, may be used to automatically hold cards. Such an auto-hold feature may be mandatory in some embodiments, or may be a selectable feature available to the player in other embodiments. In yet other embodiments, such as that described above, the player is allowed to specify which card(s), if any, to hold.

In one embodiment, the player may hold any of the cards, whether single-indicia cards or multi-indicia cards. Thus, in some embodiments, the player may actually discard a multi-indicia card(s). In one embodiment, if a player discards a multi-indicia card(s), the player will receive another multi-indicia card(s) as a replacement(s). Various embodiments can allow the multi-indicia replacement card to have the same quantity of indicia, or a different quantity of indicia. In other embodiments, discarding a multi-indicia card(s) does not guarantee that another multi-indicia card will replace the discarded multi-indicia card(s). In other words, whether a replacement card(s) is a multi-indicia card or a single-indicia card may be randomly determined. In other embodiments, the likelihood of a replacement card being a multi-indicia card may be different than the likelihood of obtaining a multi-indicia card on the initial deal. For example, the player may not be guaranteed to obtain a multi-indicia card when discarding a multi-indicia card, but one embodiment may increase (or decrease) the odds of obtaining a multi-indicia replacement card when a multi-indicia card is discarded. Other embodiments may require that the player hold some minimum number, or all, of the multi-indicia cards.

In the draw poker embodiment of FIG. 3, a plurality of resulting hands is identified 308 as a result of the replacement cards having been provided. In the illustrated embodiment, each of the resulting hands includes a different subset of the total indicia of the cards that were held and replaced, including any held/replaced cards provided with multiple card indicia. For example, in a five-card draw poker game, the player may hold four cards, one of which is a multi-indicia card with two indicia, and may receive a multi-indicia replacement card having two indicia for the single discarded card. This results in a total of seven indicia from which five-indicia subsets (i.e. resulting hands) may be derived. This can increase the odds of the player obtaining a payout, or a higher payout, for that hand.

A payout may optionally be provided 310 in embodiments of the invention. By way of example and not of limitation, a payout may be provided 310A for any of the resulting hands that match one of a plurality of winning poker rank thresholds. For example, assume five-card resulting hands, and assume the player obtained four-of-a-kind with four single-indicia cards and one multi-indicia card. With these six indicia, the four-of-a-kind would be paid out twice—once for the four-of-a-kind together with the fifth indicia, and a second time for the four-of-a-kind together with the sixth indicia. If the four-of-a-kind occurred where a total of seven indicia were available, the player could be paid on the four-of-a-kind three times. The combinations would increase if the winning hand was three-of-a-kind, as the three matching cards could be combined with each two-card permutation of the remaining cards.

As another representative example, a payout may be provided 310B for any of the resulting hands that comply with a payout rule. For example, the payout rule (which may or may not include multiple sub-rules) may indicate that at most one payout will be provided at each poker rank. As a more particular example, such a single poker rank rule may result in a maximum of one payout for a flush, even though multiple flushes occur as a result of the multiple resulting hands. Rules may also indicate that for pairs, three-of-a-kind, and four-of-a kind, only the highest poker rank will be considered. For example, if a player obtains four-of-a-kind, the player may not use combinations of those four matching cards to also obtain payouts for the pairs and three-of-a-kind combinations that could be made from those four matching cards. In other embodiments of rules, those pairs and three-of-a-kind combinations may be considered for payouts even though the player is paid on the four-of-a-kind Other embodiments may be used in connection with other poker games that do not necessarily involve a draw. A plurality of cards may be presented, where multiple card indicia are at times (e.g., randomly) presented that represent multiple cards in place of what would otherwise be a single card(s) of the card game. Such multiple card indicia may be provided in place of one or more cards of the hand. Where multiple card indicia is provided for any one or more of the cards, then a plurality of resulting hands (whether meeting paytable criteria or not) will result, providing the player with at least the perception that there is a greater chance of obtaining a payout and/or a higher payout. In determining these resulting hands in one embodiment, each of the resulting hands uses a subset of the total of the single-indicia cards and the multi-indicia cards. For example, where a five-card hand is dealt and one of the cards is a three-indicia card, then multiple five-card resulting hands are derived using the seven total indicia derived from the four single-indicia cards and the three-indicia card.

The multi-card features of the present invention may be an integral part of the poker game, or may be selectively activated. For example, the feature may be selectively activated by way of player wagers. One example is where the player makes a bonus bet or side bet, or otherwise pays to activate the feature. Another example involves the player placing the maximum wager for a game (e.g., play three credits versus playing only one credit). In another embodiment, the likelihood of multi-indicia cards occurring increases as the player's wager increases. Another example is where the player opts to play multiple hands concurrently, where such a feature is provided in connection with the game. Other examples may relate to triggering functions, such as based on how often the player is obtaining payouts on played hands. For example, a triggering function may be that the player has played at least ten hands (or other number of hands) in a row without obtaining any payout. These and other manners of invoking the features described herein may be implemented.

Figure 4A:
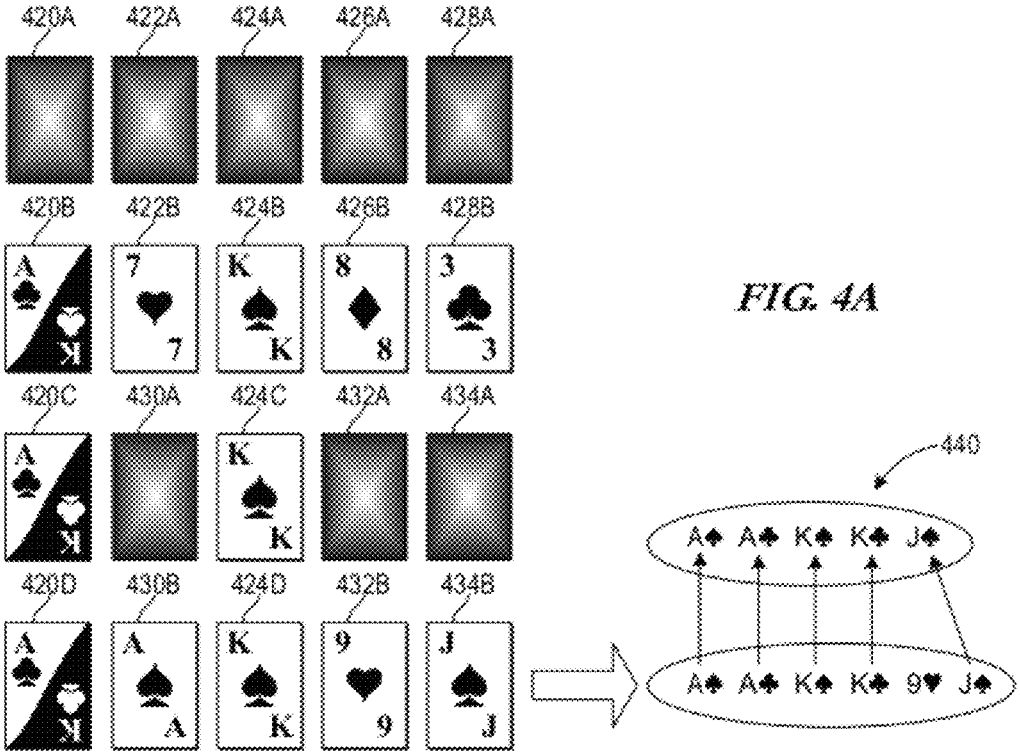
FIG. 4A is a diagram generally illustrating one manner in which multiple-indicia cards can be used to increase the number of resulting hands available for potential payouts to the player.

By way of example and not of limitation, a representative example is now described. FIG. 4A is a diagram generally illustrating one manner in which multiple-indicia cards can be used to increase the number of resulting hands available for potential payouts to the player. In the embodiment of FIG. 4A, a paytable 400 is provided that includes numerous poker rank thresholds 401-409 in which a payout is provided, as well as different payouts 410-414 depending on the amount wagered by the player. For example, assuming increasing wagers from bet-1 410 to bet-5 414, the payout amount increases for each given poker rank threshold 401-409. As a more specific example, if the player wagered three credits (BET 3 412) and obtained a full house 406, the player would win twenty-seven credits. If the player had wagered five credits (BET 5 414) and obtained a full house 406, the player would win forty-five credits. As noted above, the features associated with the invention may be integral to all gaming activity, or may be triggered upon a wagering or other event such as by wagering the maximum of five credits. However, for purposes of the example of FIG. 4A, it is assumed that the feature is integral to the game and available at all times during play.

The example of FIG. 4A assumes a draw poker embodiment where five cards 420A, 422A, 424A, 426A and 428A are initially dealt. The illustrated embodiment is an electronic embodiment played on a video poker machine or other computer-implemented apparatus, and therefore it is assumed the cards 420A, 422A, 424A, 426A and 428A are "dealt" by presenting the cards via a display screen. The cards may be dealt face down and then turned face up, or may be initially dealt face up. In either case, the cards 420A, 422A, 424A, 426A and 428A are exposed as depicted by cards 420B, 422B, 424B, 426B and 428B. Card 420B is a multiple-indicia card, which in the present example is a split card having two indicia thereon—the Ace-Clubs (A-C) and the King-Clubs (K-C). The remaining four cards are single-indicia cards including the 7-H 422B, K-S 424B, 8-D 426B and 3-C 428B.

At this point, the player has at least a pair of Kings by way of multi-indicia card 420B and single-indicia card 424B. As the game depicted is draw poker, the player has the opportunity to hold and discard cards. In the illustrated embodiment the player chooses to hold split card 420C and card 424C to hold the pair of Kings. Cards 422B, 426B and 428B are discarded, and replaced by replacement cards 430A, 432A and 434A. These cards are revealed to provide the A-S 430B, 9-H 432B and J-S 434B. At this point the player has six card indicia in which to provide multiple five-card resulting hands. In one embodiment, both the Ace-Clubs 420D and the King-Clubs from card 420D can separately be used with the remaining four cards 430B, 424D, 432B and 434B to produce two discrete results—one resulting hand using the Ace-Clubs 420D with the remaining four cards, and another resulting hand using the King-Clubs 420D with the remaining four cards.

In another embodiment, every distinct combination of the six indicia may be used to create resulting hands. For example, assuming a five-card resulting hand and one two-indicia card, six indicia are provided as shown by cards 420D, 430B, 424D, 432B and 434B. There are six discrete combinations of cards that can be produced by these six card indicia, as it is a combination without repetition based on the formula of Equation 1 below:

$$\frac{n!}{r!(n-r)!} \qquad \text{EQUATION 1}$$

where $n$ = total card indicia, and $r$ = number of cards in resulting hand

Using Equation 1, 6!/[5!(6−5)!]=6. Therefore, in this embodiment, six resulting hands are created, any of which may meet a paytable threshold to provide a payout. In the illustrated embodiment, the six combinations are shown in Table 2:

TABLE 2

| FINAL CARDS | | TOTAL SUBSETS/ RESULTING HANDS |
|---|---|---|
| A-C/K-C | (multi-indicia card) | A-C, K-C, A-S, K-S, 9-H |
| A-S | (single-indicia card) | A-C, K-C, A-S, K-S, J-S |
| K-S | (single-indicia card) | A-C, K-C, K-S, 9-H, J-S |
| 9-H | (single-indicia card) | A-C, A-S, K-S, 9-H, J-S |
| J-S | (single-indicia card) | A-C, K-C, A-S, 9-H, J-S |
| | | K-C, A-S, K-S, 9-H, J-S |

Depending on the rules provided, these six resulting hands may produce different payouts. First, assuming that the rules provide for only the "best" hand to be provided with a payout, the best hand is two pair of Aces and Kings (cards 420D, 430B and 424D, where card 420D provides both the A-C and the K-C). This is depicted at area 440, which shows how the two pair is derived from the six cards. If the player wagered five credits, the amount in the BET-5 column would pay ten credits for two pair 402.

In another representative embodiment, the rules may indicate that only one payout per poker rank 401-409 will be provided with a payout. Two of the results include "two pair" 402, and the remaining four include one pair of "jacks or better" 401. In this embodiment, and again assuming the player wagered the maximum credits, the player would win ten credits once for "two pair," and five credits once for "jacks or better," resulting in a total of fifteen credits awarded.

In another embodiment, the rules may indicate that a pair is not awardable if a higher poker rank that includes a pair is already awarded. For example, such rules may prohibit payouts on a pair of "jacks or better" if three-of-a-kind, four-of-a-kind, two pair or a full house is being awarded using that pair. In the example from the previous paragraph, this would mean that the "pair" of Aces or Kings would not result in a payout, since two pair using the pair of Aces or Kings is already being paid once. This would result in an award of ten credits to the player, for achieving two pair.

In yet another embodiment, every resulting combination may be individually paid, regardless of what the other combinations may provide. In this case, each of the six combinations in Table 2 above would provide a payout. Again assuming the player placed the maximum BET-5 414, two of the combinations would each provide ten credits for "two pair" 402, and four of the combinations would each provide five credits for "jacks or better" 401, resulting in a total award of forty credits. In such an embodiment, the payouts may be reduced across the board in order to ensure that payouts do not statistically exceed player wagers.

These and/or other rules may be implemented in any desired fashion.

It should be noted that multiple-indicia cards, such as the card 420B/C/D, may or may not have any predetermined association. In one embodiment, it is random as to what the card indicia are that present themselves on a multi-indicia card. For example, a split card having two indicia may be an Ace-Spades and King-Spades as easily as it could be a Two-Clubs and a Jack-Hearts. In other embodiments, such multiple indicia is in some way correlated, although the occurrence of the multiple-indicia card may still be random. For example, multiple indicia may be of the same suit. As another example, the multiple indicia may be within some determined range of one another, such as within two card ranks (e.g., Jack/King, Four/Six, Eight/Nine, etc.). Other embodiments could provide split cards with matching multiple indicia, such as a pair of Sixes, pair of Kings, three Aces, etc. Any desired criteria may be utilized.

As previously noted, some embodiments allow replacement cards to also be multi-indicia cards, if they are randomly provided at the time of card replacement. For example, any one or more of replacement cards 430B, 432B and 434B could have been multi-indicia cards.

Figure 4B:
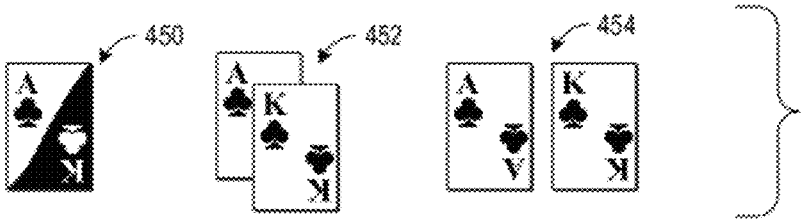
FIG. 4B illustrates various non-exclusive manners in which the multiple card indicia may be presented.

Further, any manner of depicting the multiple indicia may be implemented, as shown in FIG. 4B. This figure shows representative manners of presenting the multiple card indicia, including by way of a split card 450, overlapping cards 452, separate cards 454, etc.

In another embodiment, a feature can be provided such that when a multi-indicia card(s) is dealt, it causes an additional hand(s) to be dealt whereby the multi-indicia card(s) is evaluated for the additional hand(s). For example, if the multi-indicia card provides two indicia, an additional hand may be dealt where one indicia is used for each of the hands, or alternatively the two indicia are available for use in both hands.

Figure 5A:
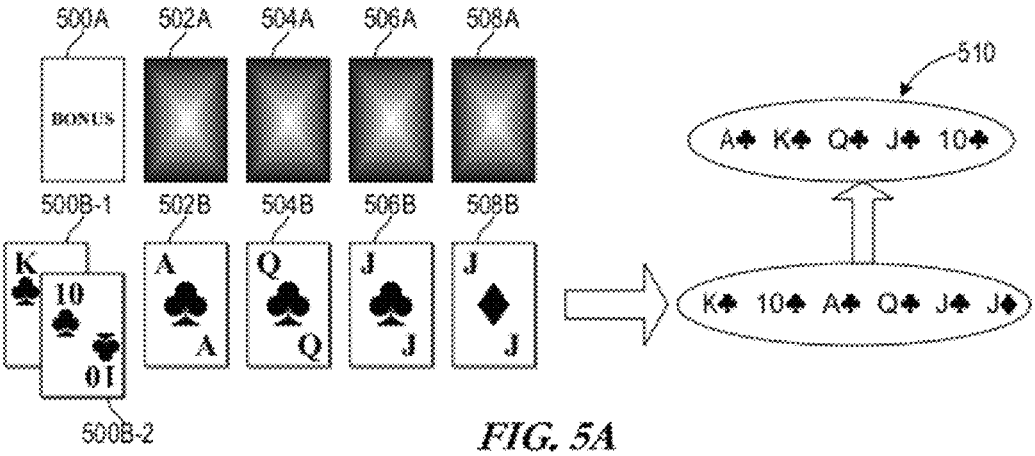
FIG. 5A illustrates an exemplary embodiment using at least one bonus card to signify that multiple card indicia will be presented.

FIG. 5A illustrates an embodiment using a bonus card(s) to signify that multiple card indicia will be presented. The example includes five cards 500A, 502A, 504A, 506A and 508A, where card 500A is a "bonus card." The bonus card could be a joker, or special card. When the special card 500A is dealt, two or more additional regular cards 500B-1, 500B-2 or other multi-indicia items from the card deck are dealt in its place. In an embodiment where only the best resulting hand is considered for payout, the player in the example of FIG. 5A would be paid for a royal flush 510. In embodiments allowing other resulting hands to be paid out, the cards 500B-1, 500B-2, 502B, 504B, 506B and 508B can also provide a pair of jacks (506B, 508B), and a straight (502B, 500B-1, 504B, 508B and 500B-2).

Figure 5B:
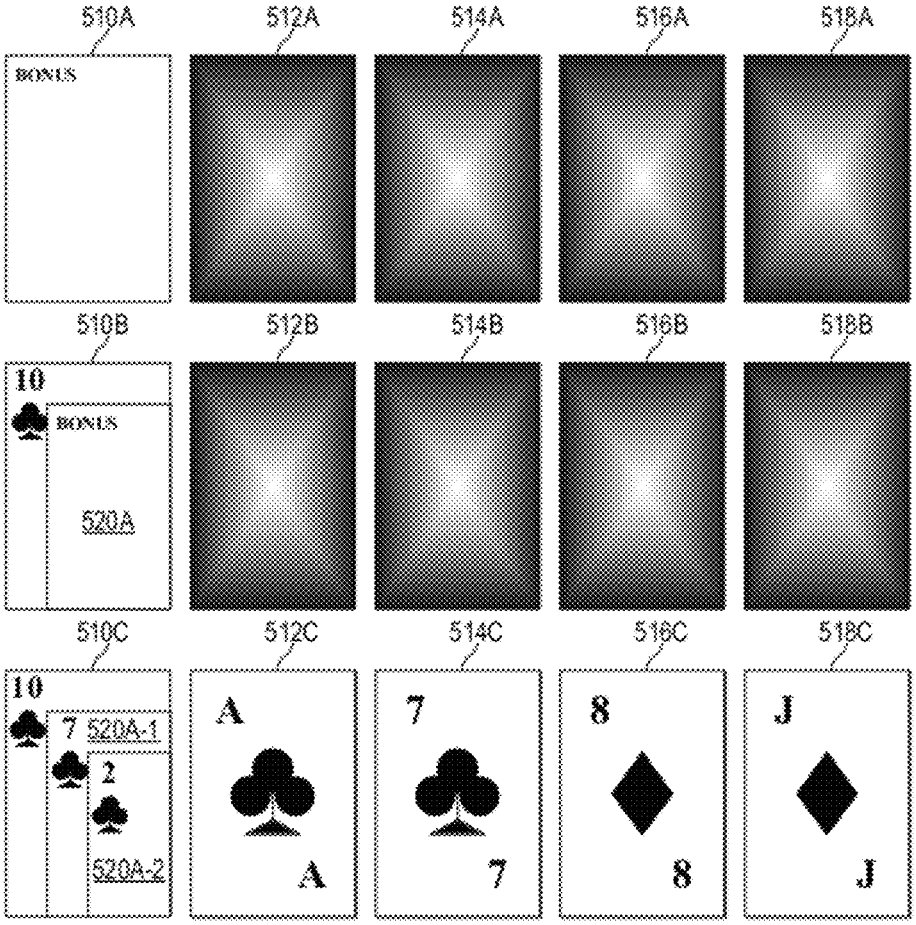
FIG. 5B illustrates an embodiment where a multi-indicia card(s) can include indicia indicating that yet another multi-indicia card is to be provided.

In the instance that one of the bonus cards 500A that is dealt is also a bonus card, it can cause yet another two (or more) cards to be dealt for that position. This is depicted in FIG. 5B, which illustrates an embodiment where a multi-indicia card can include indicia indicating that yet another multi-indicia card is to be provided. This embodiment involves five initial cards 510A, 512A, 514A, 516A and 518A. One of the cards in the example of FIG. 5B is a bonus card, which splits into two or more indicia as shown by indicia 510B and 520A. In this example, one of the indicia is a card indicium for a Ten-Clubs 510B, and the other is yet another bonus card 520A. The new bonus card 520A then splits into two or more indicia, resulting in the 7-Clubs 520A-1 and 2-Clubs 520A-2. At any point prior to, during or after this bonus activity, the remaining cards 512C, 514C, 516C and 518C are revealed. The result in the illustrated example is seven card indicia in which resulting hands can be identified for purposes of determining whether payouts will be awarded on any of the identified resulting hands. As noted above, this may be determined based in part on the payout rules, on the paytable used, and the card combinations that can be derived from the seven card indicia. It should also be noted that in a draw poker embodiment, the player could discard any of the presented cards to obtain replacement cards, and possibly obtain another one or more bonus cards that can further increase the card indicia available for use in creating resulting hands.

In one embodiment, a poker game utilizing bonus cards as described in connection with FIGS. 5A and 5B could be played with a standard card deck utilizing two jokers as the bonus cards. Alternatively, a larger number of bonus cards could be used to increase the possibility of large wins (e.g., straight flush, royal flush, etc.).

As previously noted, there are many variations of the operational and structural features that may be used in connection with the embodiments set forth herein and with other embodiments incorporating the invention. Some additional variations are now described. Regarding manners for determining the occurrence and frequency of multiple-indicia items, one possibility is that for each card position a card can be dealt, where a probability table is used to determine whether a multiple-indicia card(s) is to be presented. The probability could be fixed for all card positions, it could be different for all positions, it could be different for some positions, it could be determined by the wager level (e.g., increasing the wager increases the probability of multiple-indicia items being presented), or the like. Another representative manner for determining the occurrence/frequency of multiple-indicia items may be to determine this as each card is dealt. For example, prior to the deal, each card dealt may have a certain probability of being dealt as a multi-indicia card. The probability could be fixed for each card dealt, it could be different for each card dealt, it could be different for some cards dealt, it could be determined by the wager level (e.g., increasing the wager increases the probability of multiple-indicia items being presented), or the like.

Figure 6A:
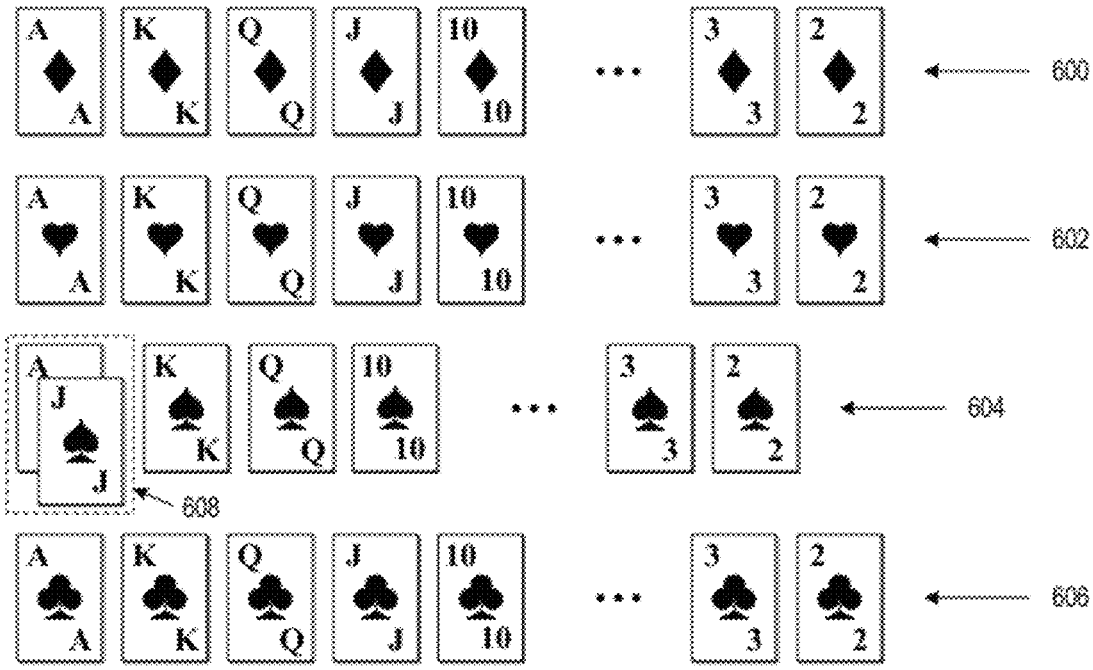
FIG. 6A illustrates one embodiment where multi-indicia cards are derived from combining, without duplication, any existing card indicia remaining in the deck.

Another variation is the manner for determining the composition of multiple-indicia cards. Multi-indicia cards may be derived from combining any cards remaining in the deck, including other multi-indicia cards. Such selection may be random, or generated from a probability table, or fixed (e.g., A-S, J-S). Where multi-indicia cards are derived from combining any cards remaining in the deck, even though there may be 52 possible cards in a deck that could be evaluated in a hand, the number of items that could appear in any hand decreases with the presence of multi-indicia cards. This is depicted in FIG. 6A, which illustrates that the act of combining, for example, the Ace-Spades/Jack-Spades reduces the number of items that could be dealt at a position. Specifically, each of the thirteen cards of each suit are depicted in rows 600, 602, 604 and 606. If the Ace-Spades and Jack-Spades is provided as a multi-indicia item 608, this reduces the number of items that could be dealt at another position. This is a result of deriving multi-indicia cards using other cards remaining in the deck (or decks) of cards.

Figure 6B:
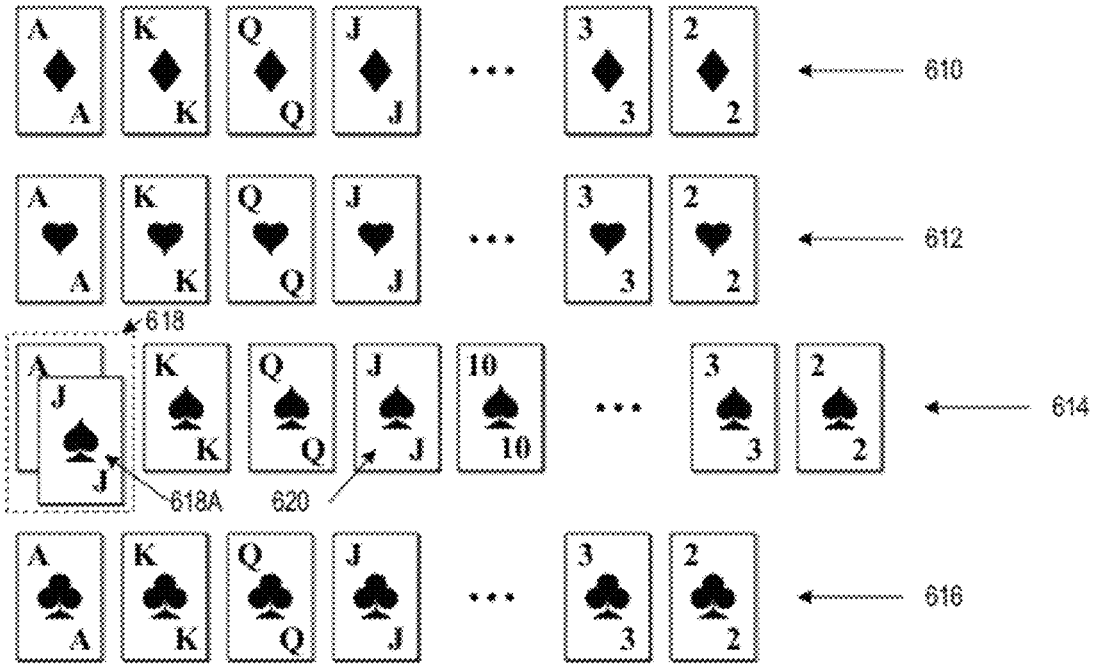
FIG. 6B illustrates one embodiment where multi-indicia cards are derived from combining, with duplication, existing card indicia in the deck.

Alternatively, multi-indicia cards may be derived from duplicating existing cards in the deck and combining them, including other multi-indicia cards. Such selection may be random, or generated from a probability table, or fixed (e.g., A-S, J-S). Where multi-indicia cards are derived from combining cards through duplication of cards in the deck, even though there may be 52 possible cards that can appear in a hand, the number of items that could appear in any hand increases with the presence of multi-indicia cards. This is depicted in FIG. 6B, which illustrates that the act of duplicating and combining, for example, the Ace-Spades/Jack-Spades created an additional card item that could be dealt. Specifically, each of the thirteen cards of each suit are depicted in rows 610, 612, 614 and 616. If the Ace-Spades and Jack-Spades is provided as a multi-indicia item 618, this creates an additional card 620, of which card indicia 618A duplicated. Thus, the Jack-Spades 620 represents an additional card that can be dealt, as it is in addition to the same card 618A provided with the multi-indicia item 618.

Other variations involve manners in which multi-indicia cards/items may be discarded in a draw poker environment. When a split card or other multi-indicia item is discarded, it may be exchanged for a randomly selected card(s) remaining in the deck, including any remaining multi-indicia items. Alternatively, it could always generate the same number of cards that appeared on the original multi-indicia item. In another embodiment, a probability table could be used to determine whether another split or multi-indicia item is dealt in its place. Such probability could be fixed, tied to the wager level (e.g., for higher wagers, increase the probability of obtaining additional multi-indicia items), etc.

In yet other embodiments in which multi-indicia cards/items may be discarded, a fixed number of cards could be generated for replacement at the position that the multi-indicia items were discarded. For example, this could be determined by the quantity of the cards at the position or the type of cards at the position. It could be a set number such as 1 or 2. It could be a set number determined by dealt position, such as card position-A generates one card; card position-2 generates two cards, card position-3 generates three cards, etc. It could be determined by the number of draws in the game; e.g., in a double-draw game, it could be fixed at three for the first draw, and two on the second draw. Alternatively it could be determined by the number of multiple indicia "positions" dealt. For example, if two positions were dealt multi-indicia items, the first one may generate two replacement indicia, and the second multi-indicia item position may generate one replacement indicia.

Figure 7A:
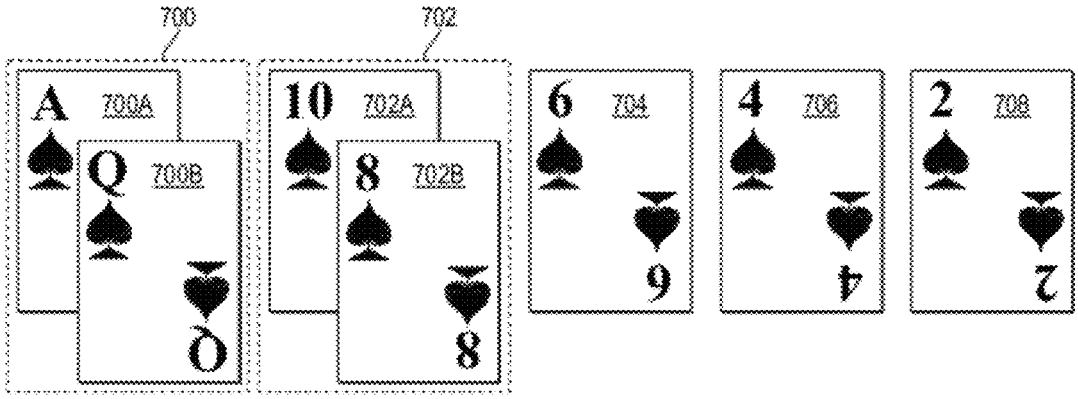
FIGS. 7A, 7B, 7C and 7D illustrate alternative, representative manners in which hands using multi-indicia items may be evaluated for payouts.

Other variations involve manners in which hands using multi-indicia items are evaluated for payouts. For example, the player may be provided a payout for the highest ranking hand (e.g., five-card hand) that is presented. In another embodiment, the player may be provided a payout for any unique five-card (or X-card) combination that appears. This is illustrated in FIG. 7A, which depicts a representative manner in which a player may be provided a payout for any unique five-card combination that appears. In this example, two multi-indicia cards 700, 702 are provided. Multi-indicia card 700 includes two card indicia, including the Ace-Spades 700A and Queen-Spades 700B. Multi-indicia card 702 also includes two card indicia, including the 10-Spades 702A and 8-Spades 702B. The remaining cards are single-indicia cards including the 6-Spades 704, 4-Spades 706 and 2-Spades 708. In one embodiment, the player may be provided with payouts for all unique flush combinations. Using Equation 1 above, the example of FIG. 7A results in twenty-one unique flush combinations, as depicted in Table 3 below:

TABLE 3

| | |
|---|---|
| A♠, Q♠, 10♠, 8♠, 6♠ | Flush |
| A♠, Q♠, 10♠, 8♠, 4♠ | Flush |
| A♠, Q♠, 10♠, 8♠, 2♠ | Flush |
| A♠, Q♠, 10♠, 6♠, 4♠ | Flush |
| A♠, Q♠, 10♠, 6♠, 2♠ | Flush |
| A♠, Q♠, 10♠, 4♠, 2♠ | Flush |
| A♠, Q♠, 8♠, 6♠, 4♠ | Flush |
| A♠, Q♠, 8♠, 6♠, 2♠ | Flush |
| A♠, Q♠, 8♠, 4♠, 2♠ | Flush |
| A♠, Q♠, 6♠, 4♠, 2♠ | Flush |
| A♠, 10♠, 8♠, 6♠, 4♠ | Flush |
| A♠, 10♠, 8♠, 6♠, 2♠ | Flush |
| A♠, 10♠, 8♠, 4♠, 2♠ | Flush |
| A♠, 10♠, 6♠, 4♠, 2♠ | Flush |
| A♠, 8♠, 6♠, 4♠, 2♠ | Flush |
| Q♠, 10♠, 8♠, 6♠, 4♠ | Flush |
| Q♠, 10♠, 8♠, 6♠, 2♠ | Flush |
| Q♠, 10♠, 8♠, 4♠, 2♠ | Flush |
| Q♠, 10♠, 6♠, 4♠, 2♠ | Flush |
| Q♠, 8♠, 6♠, 4♠, 2♠ | Flush |
| 10♠, 8♠, 6♠, 4♠, 2♠ | Flush |

Figure 7B:
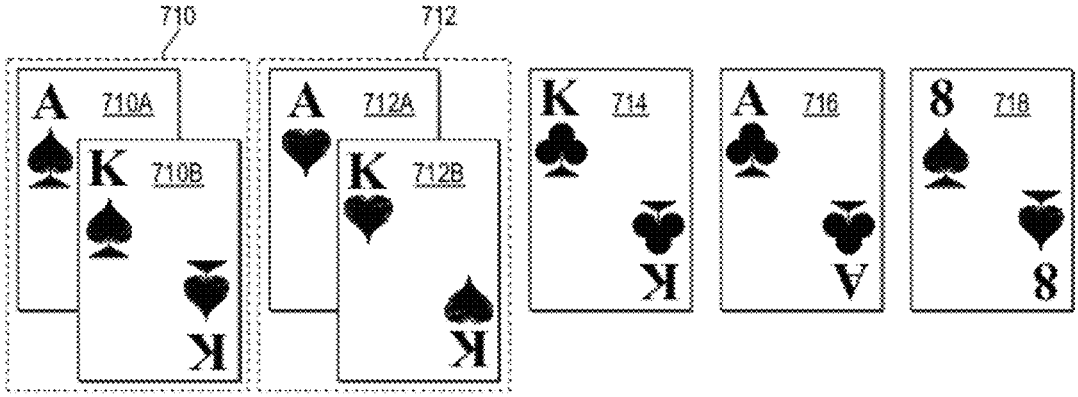

An additional example is shown in FIG. 7B. In this example, two multi-indicia cards 710, 712 are provided. Multi-indicia card 710 includes two card indicia, including the Ace-Spades 710A and King-Spades 710B. Multi-indicia card 712 also includes two card indicia, including the Ace-Hearts 712A and King-Hearts 712B. The remaining cards are single-indicia cards including the King-Spades 714, A-Clubs 716 and 8-Spades 718. Assuming an embodiment where the player may be provided with payouts for all awardable card combinations, the results are shown in Table 4 below:

TABLE 4

| | | | | | | |
|---|---|---|---|---|---|---|
| A♠, | K♠, | A♥, | K♥, | K♣ | Full House | Kings full of Aces |
| A♠, | K♠, | A♥, | K♥, | A♣ | Full House | Aces full of Kings |
| A♠, | K♠, | A♥, | K♥, | 8♠ | Two Pair | Aces & Kings, 8 |
| A♠, | K♠, | A♥, | K♣, | A♣ | Full House | Aces full of Kings |
| A♠, | K♠, | A♥, | K♣, | 8♠ | Two Pair | Aces & Kings, 8 |
| A♠, | K♠, | A♥, | A♣, | 8♠ | 3 of Kind | Aces, King & 8 |
| A♠, | K♠, | K♥, | K♣, | A♣ | Full House | Kings full of Aces |
| A♠, | K♠, | K♥, | K♣, | 8♠ | 3 of Kind | Kings, Ace & 8 |
| A♠, | K♠, | K♥, | A♣, | 8♠ | Two Pair | Aces & Kings 8 |
| A♠, | K♠, | K♣, | A♣, | 8♠ | Two Pair | Aces & Kings 8 |
| A♠, | A♥, | K♥, | K♣, | A♣ | Full House | Aces full of Kings |
| A♠, | A♥, | K♥, | K♣, | 8♠ | Two Pair | Aces & Kings, 8 |
| A♠, | A♥, | K♥, | A♣, | 8♠ | 3 of Kind | Aces, King & 8 |
| A♠, | A♥, | K♣, | A♣, | 8♠ | 3 of Kind | Aces, King & 8 |
| A♠, | K♥, | K♣, | A♣, | 8♠ | Two Pair | Aces & Kings, 8 |
| K♠, | A♥, | K♥, | K♣, | A♣ | Full House | Kings full of Aces |
| K♠, | A♥, | K♥, | K♣, | 8♠ | 3 of Kind | Kings, Ace & 8 |
| K♠, | A♥, | K♥, | A♣, | 8♠ | Two Pair | Aces & Kings, 8 |
| K♠, | A♥, | K♣, | A♣, | 8♠ | Two Pair | Aces & Kings, 8 |
| K♠, | K♥, | K♣, | A♣, | 8♠ | 3 of Kind | Kings, Ace & 8 |
| A♥, | K♥, | K♣, | A♣, | 8♠ | Two Pair | Aces & Kings, 8 |

Figure 7C:
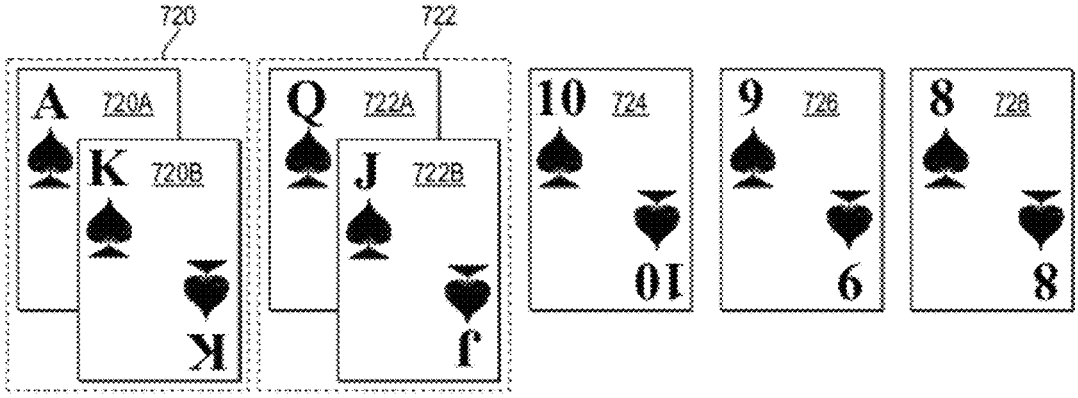

Still other variations exist in which hands using multi-indicia items may be evaluated for payouts. For example, the number of unique X-card (e.g., 5-card) combinations may be limited. For example, payouts may be limited such that combinations having the same pay on a standard poker pay schedule are not repeated, or are repeated some limited number of times. In one example, payouts are provided for only one instance of a unique combination on the pay schedule; e.g., only one payout for a royal flush, only one payout for a straight flush, only one payout for a flush, etc. This is depicted in FIG. 7C, which illustrates a representative manner in which a player may be provided payouts for limited five-card combinations that are presented. In this example, two multi-indicia cards 720, 722 are provided. Multi-indicia card 720 includes two card indicia, including the Ace-Spades 720A and King-Spades 720B. Multi-indicia card 722 also includes two card indicia, including the Queen-Spades 722A and Jack-Spades 722B. The remaining cards are single-indicia cards including the 10-Spades 724, 9-Spades 726 and 8-Spades 728. In one embodiment, the player may be provided with payouts for a limited number of resulting hand combinations. Assuming an embodiment where the player may be provided with payouts for only one resulting hand at each instance of a unique combination on the pay schedule, the results are shown in Table 5 below:

TABLE 5

| | |
|---|---|
| A♠, K♠, Q♠, J♠, 10♠ | Royal Flush |
| A♠, K♠, Q♠, J♠, 9♠ | ~~Flush~~ |
| ~~A♠, K♠, Q♠, J♠, 8♠~~ | ~~Flush~~ |
| ~~A♠, K♠, Q♠, 10♠, 9♠~~ | ~~Flush~~ |
| ~~A♠, K♠, Q♠, 10♠, 8♠~~ | ~~Flush~~ |
| ~~A♠, K♠, Q♠, 9♠, 8♠~~ | ~~Flush~~ |
| ~~A♠, K♠, J♠, 10♠, 9♠~~ | ~~Flush~~ |
| ~~A♠, K♠, J♠, 10♠, 8♠~~ | ~~Flush~~ |
| ~~A♠, K♠, J♠, 9♠, 8♠~~ | ~~Flush~~ |

TABLE 5-continued

| | |
|---|---|
| ~~A♠, K♠, 10♠, 9♠, 8♠~~ | ~~Flush~~ |
| ~~A♠, Q♠, J♠, 10♠, 9♠~~ | ~~Flush~~ |
| ~~A♠, Q♠, J♠, 10♠, 8♠~~ | ~~Flush~~ |

TABLE 5-continued

| | |
|---|---|
| ~~A♠, Q♠, J♠, 9♠, 8♠~~ | ~~Flush~~ |
| ~~A♠, Q♠, 10♠, 9♠, 8♠~~ | ~~Flush~~ |
| ~~A♠, J♠, 10♠, 9♠, 8♠~~ | ~~Flush~~ |
| K♠, Q♠, J♠, 10♠, 9♠ | Straight Flush |
| ~~K♠, Q♠, J♠, 10♠, 8♠~~ | ~~Flush~~ |
| ~~K♠, Q♠, J♠, 9♠, 8♠~~ | ~~Flush~~ |
| ~~K♠, Q♠, 10♠, 9♠, 8♠~~ | ~~Flush~~ |
| ~~K♠, J♠, 10♠, 9♠, 8♠~~ | ~~Flush~~ |
| ~~Q♠, J♠, 10♠, 9♠, 8♠~~ | ~~Straight Flush~~ |

As can be seen, of the twenty-one resulting hands, one payout is provided for a royal flush, one payout for a flush, and one payout for a straight flush. In other embodiments, the number of unique combinations paid at each pay schedule level may be capped at some number greater than one, such as the top three paying combinations at each pay schedule level.

Still other variations exist in which hands using multi-indicia items may be evaluated for payouts. For example, duplicate or like-winning combinations may be awarded by way of a limited pay schedule. For example, using the example above in FIG. 7C, payouts could be provided for all of the unique combinations that appear, but lower amounts may be paid for duplicate combinations of the same poker rank. As a more particular example, the first straight flush may pay a certain value, but the second instance of the straight flush may pay less. Third and further instances of the straight flush may pay the same as the second instance, or may continue to pay less on a decreasing scale.

Still other variations in which the features of the invention may be practiced relate to the number of cards, or decks of cards, that are used. For example, the cards generated by a multi-indicia card could come from a deck of cards separate from the deck of cards providing the other cards of the deck. This separate deck could be a standard 52-card deck. The multi-indicia cards could alternatively be provided from a premium deck; e.g., composed of all 10, Jack, Queen, King, and Ace cards.

In other embodiments, the multi-indicia cards could be generated from a separate deck, while having a particular probability of being a card closely related to the suit and/or rank of the card that generated the split. One embodiment involves a suited probability. As an example, the Ace-Spades may generate a multi-indicia card, and cards from the same suit as the Ace-Spades could be randomly selected (e.g., cards including the 2-Spades through the King-Spades). Another embodiment involves a ranked probability. As an example, the Ace-Spades may generate a multi-indicia card, and cards from within X cards (e.g., two cards) of the Ace may be randomly selected. In the case of a two-card range, the additional card indicia to accompany the Ace-Spades would be any King, Queen, Two or Three. Another embodiment involves both ranked and suited probability. As an example, the Ace-Spades may generate a multi-indicia card, and cards from within X cards (e.g., two cards) of the Ace-Spades, and of the same suit (e.g., Spades in this example) could be randomly selected to accompany the Ace-Spades in a multi-indicia item. In this example the available cards to accompany the Ace-Spades would be the King-Spades, Queen-Spades, 2-Spades and 3-Spades.

Figure 7D:
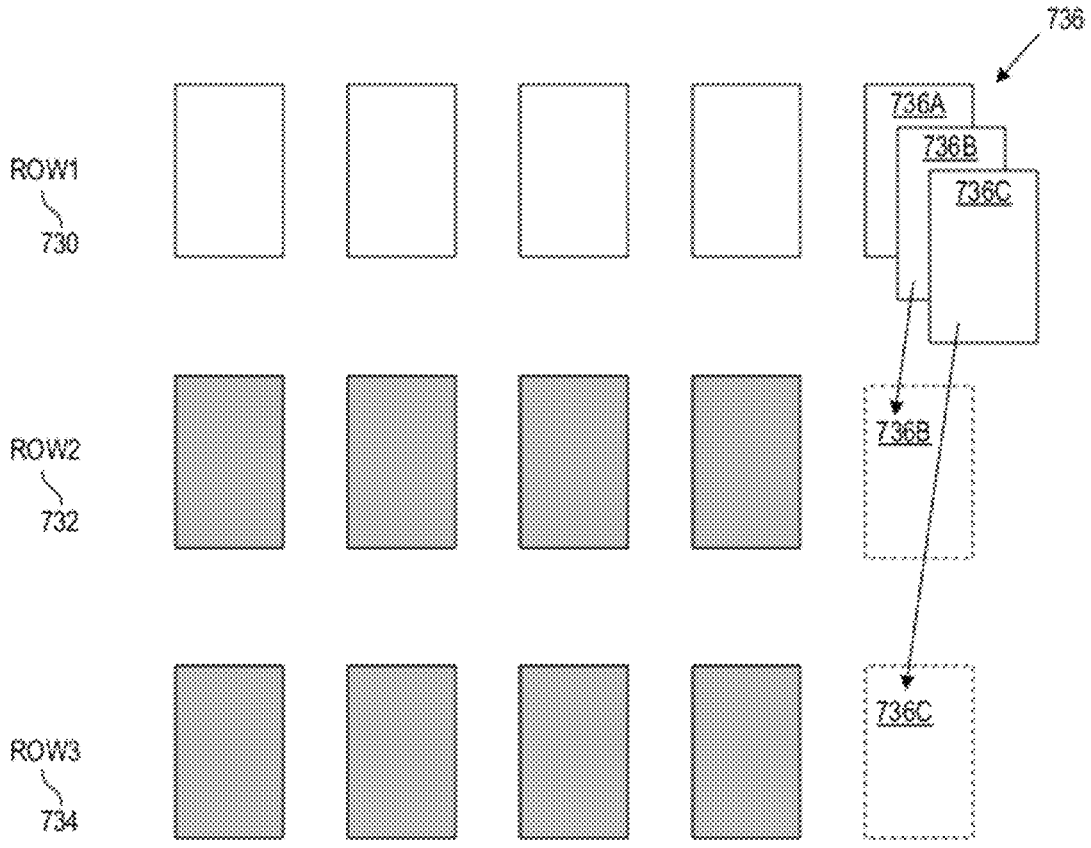

In other embodiments, the multi-indicia cards could be generated based on the card position in which the multi-indicia card(s) is to occur. For example, in a five-card hand the first position may be referred to as card position-1, the second position may be referred to as card position-2, and so forth through card position-5. For each multi-indicia card generated in a particular position, a different level may be assigned. For example, the first multi-indicia card dealt in position 1 may be dealt on level 1, the second multi-indicia card dealt in that position may be dealt on level 2, the third multi-indicia card dealt in that position may be dealt on level 3, and so forth. An example is shown in FIG. 7D. In this example, the multi-indicia card(s) are used to complete additional hands in a multi-hand embodiment. More specifically, the example of FIG. 7D involves utilizing the first indicia 736A of the multi-indicia card 736 in row-1 730; the second indicia 736B of the multi-indicia card 736 in row-2 732; and the third indicia 736C of the multi-indicia card 736 in row-3 734. In this manner, multi-indicia cards may be used to complete hands in a multiple-hand embodiment.

As previously noted, the invention may be utilized in various poker games including hold'em poker. For example, a multi-indicia card provided on the board (e.g., flop, turn and/or river) could create additional anticipation and excitement as one or more additional card indicia may be made available for each of the players to potentially further enhance their respective resulting hands. In such an embodiment, one or more multi-indicia cards may be introduced after the player's hole cards are dealt so that the multi-indicia card(s) is only available on the board. In other embodiments, multi-indicia cards may be provided in the entire playable deck, thereby making it possible that a player(s) receives a multi-indicia card(s). In one embodiment, the rules may require a player receiving a multi-indicia hole card to declare this card after the deal and exchange it for two cards dealt face down.

The present invention may be played in connection with live table games, or in electronic embodiments. In live table games, the deck(s) of cards may include multi-indicia cards, or multiple cards may be dealt at a particular position(s) and in response to a random triggering event (e.g., dealing a joker or other special card, as previously described). In one embodiment of a live table game, the multi-indicia item features may be implemented using a card reader or other mechanism that generates a "split," and then deals a single split card, or two or more discrete cards to a player in a fashion that signifies a "split"; e.g., two cards dealt on top of each other in an overlapping fashion to show the card indicia from each of the cards. Another technique involves creating a special "split deck" with all of the split combinations to be used. This "split deck" could be used in conduction with a standard 52-card deck. There could be two card readers that communicate with one another, or communicate to another device such as a server, where one reader is for the "split" deck and the other for the standard deck. When standard cards are dealt, those combinations may be deactivated from the split deck. Conversely, when split cards are dealt, cards appearing in the split deck may be removed from the standard deck.

In electronic embodiments, multiple hands may be played concurrently. For example, a first hand in a draw poker embodiment may be presented that may include one or more multi-indicia cards. The player may hold any of the cards, including the one or more multi-indicia cards. Upon those cards being held, they can be replicated into any number of concurrently played hands. Cards that are not held are replaced, and any held multi-indicia card can then be used in each concurrently played hand in the manner described herein for a single hand. The player may be required to pay additional wagers to play the additional hands concurrently.

Figure 8:
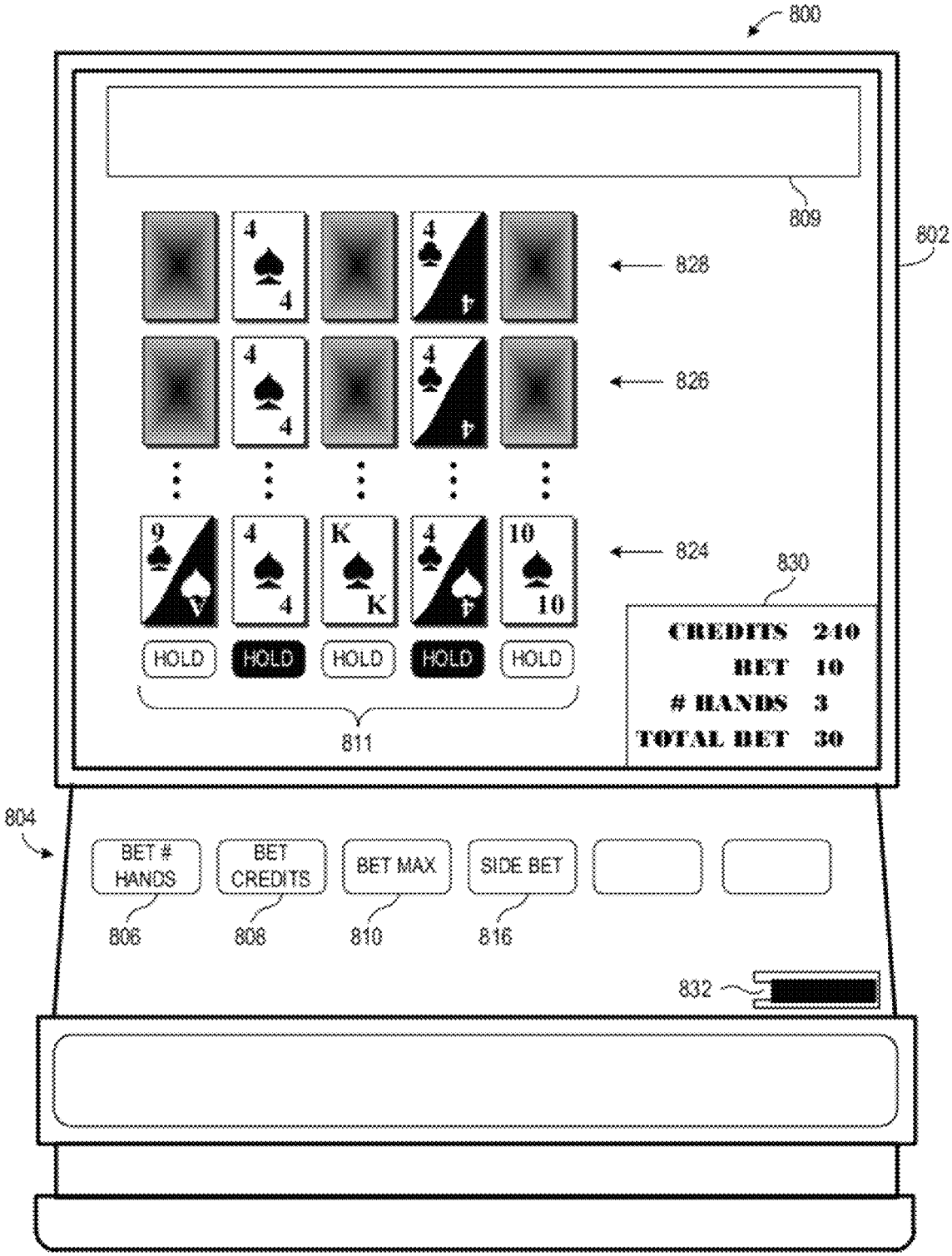
FIG. 8 illustrates a representative embodiment of a casino-style gaming device in which the principles of the present invention may be applied.

The present invention may be used in connection with slot machines, computing devices and/or other gaming devices. FIG. 8 illustrates a representative embodiment of a casino-style gaming device in which the principles of the present invention may be applied. For purposes of explanation, the description of the gaming device is FIG. 8 is provided in terms of a kiosk, slot machine, or video poker machine 800. However, the present invention is analogously applicable to other computer-based systems.

The illustrated gaming machine 800 includes a computing system (not shown) to carry out operations according to the invention. The illustrated gaming machine 800 includes a display 802, and a user interface 804, although some or all of the user interface may be provided via the display 802 in touch screen embodiments. The user interface 804 allows the user to control and engage in play of the gaming machine 800. The particular user interface mechanisms associated with user interface 804 is dependent on the type of gaming machine. For example, the user interface 804 may include one or more buttons, switches, joysticks, levers, pull-down handles, trackballs, voice-activated input, or any other user input system or mechanism that allows the user to play the particular gaming activity. The user interface 804 may allow the user to enter coins, bills, or otherwise obtain credits through vouchers, tokens, credit cards, tickets, etc. Various mechanisms for entering such vouchers, tokens, credit cards, coins, tickets, etc. are known in the art. For example, coin/token input mechanisms, card readers, credit card readers, smart card readers, punch card readers, and other mechanisms may be used to enter wagers. It is through the user interface 804 that the user can initiate and engage in a gaming activity in accordance with the invention. For example, the user can use the user interface 804 and/or touch screen inputs to place wagers 808, hold cards 811, activate multi-indicia card features in some embodiments, make gaming decisions (e.g., bet max) 810 or place side bets 816 that will otherwise make the user eligible for such features, and the like. While the illustrated embodiment depicts various buttons for the user interface 804, it should be recognized that a wide variety of user interface options are available for use in connection with the present invention, including pressing buttons, touching a segment of a touch-screen, entering text, entering voice commands, or other known user entry methodology. The particular user interface mechanism utilized is not relevant to the present invention.

The display device 802 may include one or more of an electronic display, a mechanical display, and fixed display information such as information such as paytable information associated with a glass/plastic panel 809 on the gaming machine 800. A display segment or panel 830 may also be provided to display information such as the accumulated credits, current bet amount such as "10" credits (where credits may represent, for example, coins, tokens, dollars, etc.), the number of hands played, total bet, the number of credits paid out or "won" on a particular play, etc. A wager acceptor 832 is operative to receive wager tokens, coins, bills, credit/debit cards, coupons, smart cards, prepaid casino cards, electronic fund transfer (EFT), tickets, and the like.

In the illustrated embodiment, the user is shown to play a draw poker hand 824, where the player has opted to hold the 4-Spades and a multi-indicia card including the 4-Clubs and 4-Hearts. In a single hand game, the remaining cards would be replaced, with the possibility of replacement cards being multi-indicia cards in one embodiment. The illustrated embodiment also illustrates an embodiment where the player can concurrently play multiple hands, depicted by additional hands 826, 828. In such an embodiment, the held cards (4-Spades and multi-indicia card including the 4-Clubs and 4-Hearts) are replicated into the other hands 826, 828. These other hands 826, 828 can also receive replacement cards, which in one embodiment may include additional multi-indicia cards.

Figure 9:
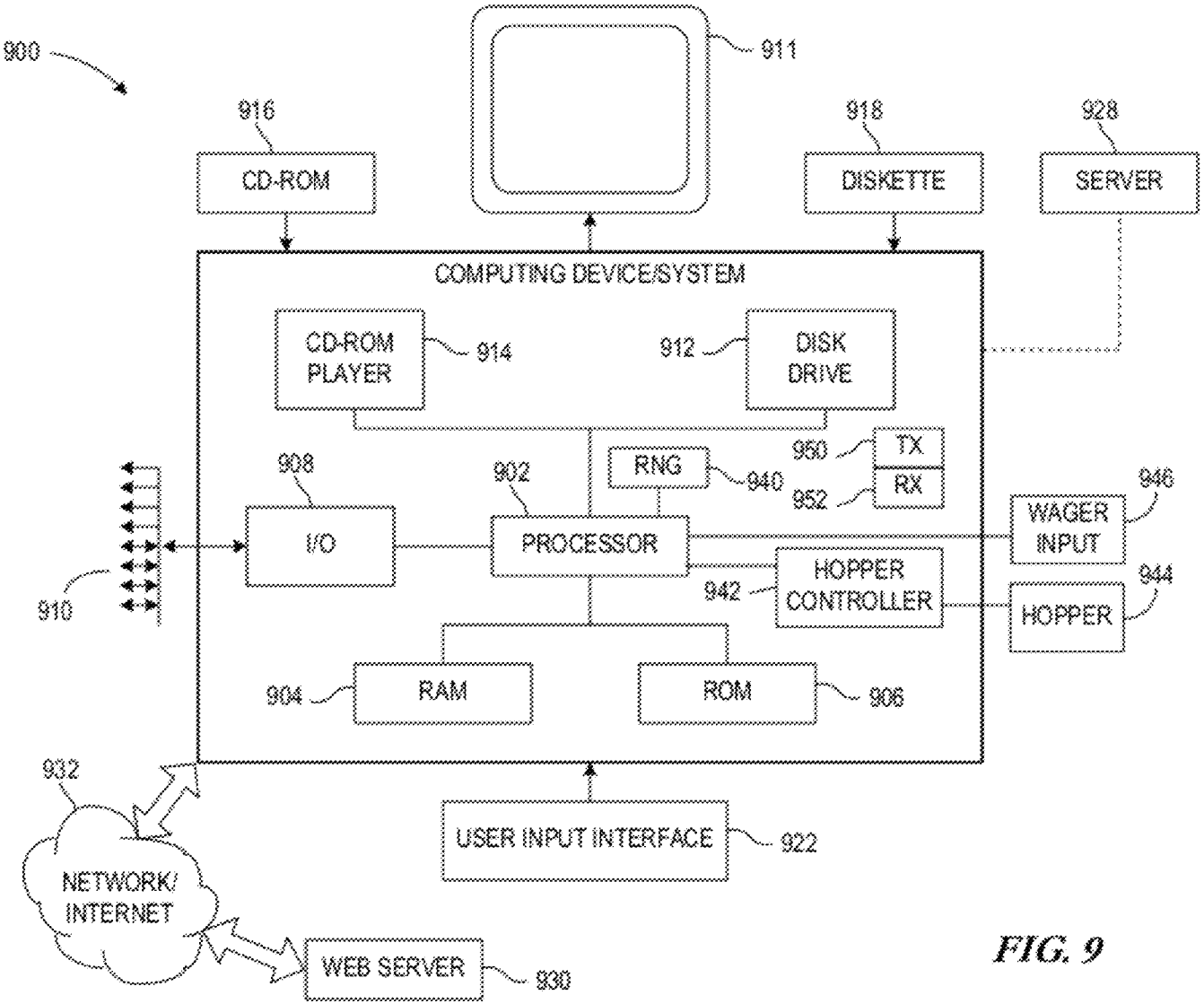
FIG. 9 illustrates representative computing components capable of carrying out operations in accordance with the invention.

As may now be readily understood, the device 800 may be programmed to facilitate the various embodiments of the invention. The present invention may be implemented as a casino gaming machine such as a video poker machine or other special purpose gaming kiosk as described in FIG. 8, or may be implemented via computing systems operating under the direction of local gaming software, and/or remotely-provided software such as provided by an application service provider (ASP). The casino gaming machine utilize a computing system to control and manage the gaming activity. An example of a representative computing system capable of carrying out operations in accordance with the invention is illustrated in FIG. 9.

Hardware, firmware, software or a combination thereof may be used to perform the various gaming functions, display presentations and operations described herein. The functional modules used in connection with the invention may reside in a gaming machine as described, or may alternatively reside on a stand-alone or networked computing device/system. The computing structure 900 of FIG. 9 is an exemplary computing structure that can be used in connection with such electronic gaming machines, computers, or other computer-implemented devices to carry out operations of the present invention. It should be noted that the representative computing structure of FIG. 9 or analogous computing structure may be used on a local computer, kiosk, server, or any other device providing or serving the gaming functions. It should also be noted that the computing arrangement of FIG. 9 may be distributed across multiple devices (e.g., processing components at a server, and display and user interface components at a local gaming machine, etc.).

The example computing arrangement 900 suitable for performing the gaming functions in accordance with the present invention typically includes a central processor (CPU) 902 coupled to random access memory (RAM) 904 and some variation of read-only memory (ROM) 906. The ROM 906 may also represent other types of storage media to store programs, such as programmable ROM (PROM), erasable PROM (EPROM), etc. The processor 902 may communicate with other internal and external components through input/output (I/O) circuitry 908 and bussing 910, to provide control signals, communication signals, and the like.

Chance-based gaming systems such as video poker machines, in which the present invention is applicable, are governed by random numbers and processors. A display device 911 is used to display the gaming activity as facilitated by one or more random number generators (RNG). RNGs are well-known in the art, and may be implemented using hardware, software operable in connection with the processor 902, or some combination of hardware and software. The present invention is operable using any known RNG, and may be integrally programmed as part of the processor 902 operation, or alternatively may be a separate RNG controller 940.

The computing arrangement 900 may also include one or more data storage devices, including hard and floppy disk drives 912, CD-ROM drives 914, and other hardware capable of reading and/or storing information such as DVD, FLASH drives, etc.

In one embodiment, software for carrying out the operations in accordance with the present invention may be stored and distributed on a CD-ROM 916, diskette 918, DVD, FLASH device or other form of media capable of portably storing information. These storage media may be inserted into, and read by, devices such as the CD-ROM drive 914, the disk drive 912, etc. The software may also be transmitted to the computing arrangement 900 via data signals, such as being downloaded electronically via a network, such as the Internet. Further, as previously described, the software for carrying out the functions associated with the present invention may alternatively be stored in internal memory/storage of the computing device 900, such as in the ROM 906 or other storage.

The computing arrangement 900 is coupled to the display 911, which represents a display on which the gaming activities in accordance with the invention are presented. The display 911 may be any type of known display or presentation screen, such as LCD displays, plasma display, cathode ray tubes (CRT), etc. Where the computing device 900 represents a stand-alone or networked computer, the display 911 may represent a standard computer terminal or display capable of displaying multiple windows, frames, etc. Where the computing device is embedded within an electronic gaming machine (see FIG. 8), the display 911 corresponds to the display screen of the gaming machine/kiosk. A user input interface 922 such as a mouse, buttons, keyboard/keypad, microphone, touch pad, trackball, joystick, touch screen, voice-recognition system, etc. may be provided.

The computing arrangement 900 may be connected to other computing devices or gaming machines, such as via a network. The computing arrangement 900 may be connected to a network server 928 in an intranet or local network configuration. The computer may further be part of a larger network configuration as in a global area network (GAN) such as the Internet. In such a case, the computer accesses one or more web servers 930 via the network/Internet 932.

Other components directed to gaming machine implementations include manners of gaming participant payment, and gaming machine payout. For example, a gaming machine including the computing arrangement 900 may also include a hopper controller 942 to determine the amount of payout to be provided to the participant. The hopper controller may be integrally implemented with the processor 902, or alternatively as a separate hopper controller 942. A hopper 944 may also be provided in gaming machine embodiments, where the hopper serves as the mechanism holding the coins/tokens of the machine. The wager input module 946 represents any mechanism for accepting coins, tokens, coupons, bills, electronic fund transfer (EFT), tickets, credit cards, smart cards, membership cards, etc., for which a participant inputs a wager amount.

Additionally, the computing arrangement 900 may include a transmitter (TX) 950, and may include a receiver (RX) 952. These TX 950 and RX 952 components may be discrete components, or aggregated such as in the case of a transceiver. The receiver function provided by the RX 952 can be configured to receive information from any type of network, such as a local area network (LAN), wireless LAN (e.g., 802.11 a/b/g), wired network (e.g., Internet), wireless network (e.g., Global System for Mobile Communications/General Packet Radio Service (GSM/GPRS), proximity networks (e.g., Bluetooth, peer-to-peer networks), and/or other wired/wireless network technologies. For example, the RX 952 may receive programming and/or operational information from a server 928 or 930 where the system is server-based. Any such server may include computing components analogous to those depicted in FIG. 9. Information such as wager information or other data used by a server can be provided to the appropriate server 928, 930 or other device or network entity via the TX 950.

It should also be recognized that the computing arrangement 900 of FIG. 9 may be implemented in a gaming apparatus, or in a server or other network entity that determines and provides multi-indicia card features in accordance with the invention.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., slot machines involving poker or card games that could be played via table games).

What is claimed is:

1. A method comprising:

determining, by a processor, whether any one or more of a plurality of cards of a draw poker hand are to be randomly provided with multiple card indicia representing multiple cards;

presenting the plurality of cards of the draw poker hand on a display, including the one or more of the plurality of cards determined to be randomly provided with multiple card indicia;

facilitating user identification of which of the plurality of cards to hold;

replacing the cards that are not held; and identifying a plurality of resulting hands, each of the plurality of resulting hands including a different subset of a total of the indicia of the cards that were held, the cards that were replaced, and any cards provided with multiple card indicia.

2. The method of claim 1, further comprising providing a payout for any of the plurality of resulting hands that matches one of a plurality of winning poker rank thresholds.

3. The method of claim 1, further comprising providing a payout for any of the plurality of resulting hands that comply with a payout rule.

4. The method of claim 3, wherein providing a payout for any of the plurality of resulting hands that complies with a payout rule comprises providing a payout for at most one resulting hand that matches each winning poker rank threshold.

5. The method of claim 3, wherein providing a payout for any of the plurality of resulting hands that complies with a payout rule comprises providing a payout for a predetermined number of the resulting hands that match each winning poker rank threshold.

6. The method of claim 1, wherein presenting the one or more of the plurality of cards determined to be randomly provided with multiple card indicia comprises, for each of the one or more cards determined to be randomly provided, presenting the multiple card indicia representing the multiple cards substantially in place of what would otherwise be a respective single card of the draw poker hand.

7. The method of claim 1, wherein identifying a plurality of resulting hands comprises identifying each five-card subset of the six or more indicia presented by way of the cards that were held, the cards that were replaced, and any of the held and replacement cards provided with the multiple card indicia.

8. The method of claim 1, wherein determining whether any one or more of a plurality of cards of a draw poker hand is to be randomly provided with multiple card indicia representing multiple cards comprises utilizing a random number generator to facilitate the determination of whether any one or more of a plurality of cards of a draw poker hand is to be randomly provided with multiple card indicia representing multiple cards.

9. The method of claim 1, wherein facilitating user identification of which of the plurality of cards to hold comprises providing the user with a user interface capable of enabling identification of any of the plurality of cards in which to hold.

10. The method of claim 1, further comprising holding each of the multiple card indicia for the one or more cards held by the user that are provided with the multiple card indicia.

11. The method of claim 1, wherein presenting the cards determined to be randomly provided with multiple card indicia comprises presenting the cards determined to be randomly provided with multiple card indicia as single cards each having a plurality of different card indicia thereon.

12. The method of claim 1, wherein presenting the cards determined to be randomly provided with multiple card indicia comprises presenting the cards determined to be randomly provided with multiple card indicia as multiple overlapping cards each having a plurality of different card indicia thereon.

13. The method of claim 1, wherein replacing the cards that are not held comprises replacing the cards that were not held with cards that each include only one card indicium.

14. The method of claim 1, wherein replacing the cards that are not held comprises replacing the cards that were not held with one or more first cards that each include only one card indicium, and with one or more second cards that each include a plurality of indicia.

15. The method of claim 1, wherein replacing the cards that are not held comprises replacing the cards that were not held with cards that each include a plurality of indicia.

16. An apparatus comprising:

a processor configured to determine whether any one or more of a plurality of cards of a draw poker hand are to be randomly provided with multiple card indicia representing multiple cards;

a display to present the plurality of cards of the draw poker hand, and to present the one or more of the plurality of cards having multiple card indicia if the processor determined any of the one or more of the cards of the draw poker hand to be provided with multiple card indicia;

a user interface configured to receive an indication of which of the plurality of cards of the draw poker hand to hold; and wherein the processor is further configured to replace the cards that are not held, and to identify a plurality of resulting hands, each of the plurality of resulting hands including a different subset of a total of the indicia of the cards that were held, the cards that were replaced, and any cards provided with multiple card indicia.

17. The apparatus of claim 16, wherein the processor is configured to identify every five-card combination of the total of the indicia of the cards that were held, the cards that were replaced, and any cards provided with multiple card indicia.

18. The apparatus of claim 17, wherein the processor is further configured to compare each of the five-card combinations to at least one paytable of poker ranks, and to award a payout for all of the five-card combinations matching any of the poker ranks in the paytable.

19. The apparatus of claim 17, wherein the processor is further configured to compare each of the five-card combinations to at least one paytable of poker ranks, and to award a payout for a predetermined number of the five-card combinations matching a respective one of the poker ranks in the paytable.

20. The apparatus of claim 17, wherein the processor is further configured to compare each of the five-card combinations to at least one paytable of poker ranks, and to award a payout for the best five-card combination matching a respective one of the poker ranks in the paytable.

21. A non-transitory computer-readable medium having instructions stored thereon which are executable by a computer system by performing steps comprising:

determining whether any one or more of a plurality of cards of a draw poker hand are to be randomly provided with multiple card indicia representing multiple cards;

presenting the plurality of cards of the draw poker hand, including the one or more of the plurality of cards determined to be randomly provided with multiple card indicia;

facilitating user identification of which of the plurality of cards to hold;

replacing the cards that are not held; and identifying a plurality of resulting hands, each of the plurality of resulting hands including a different subset of a total of the indicia of the cards that were held, the cards that were replaced, and any cards provided with multiple card indicia.

* * * * *